US006617836B1

(12) United States Patent
Doyle et al.

(10) Patent No.: US 6,617,836 B1
(45) Date of Patent: Sep. 9, 2003

(54) CMOS SUB-BANDGAP REFERENCE WITH AN OPERATING SUPPLY VOLTAGE LESS THAN THE BANDGAP

(75) Inventors: James T. Doyle, Nederland, CO (US); Yushan Li, Longmont, CO (US)

(73) Assignee: National Semiconductor Corporation, Sunnyvale, CA (US)

( * ) Notice: Subject to any disclaimer, the term of this patent is extended or adjusted under 35 U.S.C. 154(b) by 0 days.

(21) Appl. No.: 10/142,083

(22) Filed: May 8, 2002

(51) Int. Cl.[7] ..... G05F 3/16

(52) U.S. Cl. ..... 323/316; 323/901; 327/539; 327/542

(58) Field of Search ..... 323/313, 314, 323/315, 316, 901; 327/534, 535, 539, 540, 541, 542

(56) References Cited

U.S. PATENT DOCUMENTS 5,774,013 A * 6/1998 Groe ..... 327/543

6,407,622 B1 * 6/2002 Opris ..... 327/539

* cited by examiner

*Primary Examiner*—Shawn Riley

(74) *Attorney, Agent, or Firm*—Wagner, Murabito & Hao LLP

(57) ABSTRACT

A circuit that outputs a stable reference voltage with an operating supply voltage less than the band gap potential and also less than a zero-bias threshold voltage. In one embodiment, the sub-band gap circuit includes an operational amplifier having an N-well input stage operating in the sub-threshold region, and a proportional to absolute temperature (PTA) current source having a forward-biased P-bulk. In another embodiment, the operational amplifier realizes sub-one volt operation by making use of back gating as the input stage, allowing full rail-to-rail input and output swings.

20 Claims, 52 Drawing Sheets

CM OS SUB-BANDGAP REFERENCE WITH AN OPERATING SUPPLY VOLTAGE LESS THAN THE BANDGAP

TECHNICAL FIELD

Embodiments of the present invention pertain to integrated circuits. Specifically, embodiments of the present invention pertain to a circuit that can provide a sub-band gap reference voltage with operating supply voltage less than the band gap potential.

BACKGROUND ART

Many contemporary CMOS (complementary metal-oxide silicon) integrated circuit chips contain a large digital core along with some peripheral analog circuitry. The analog circuitry typically includes reference voltage circuits that are relied upon by various analog blocks and/or by select digital circuits. These reference voltage circuits should optimally provide a stable, dependable and accurate reference voltage.

One of the most widely adopted reference voltage circuits is referred to as a "band gap" circuit. The band gap circuit is based on an established physical phenomenon exhibited by silicon. Basically, silicon has a band gap potential of 1.21 volts. The band gap potential of silicon can be exploited to produce an extremely reliable and tight reference voltage.

According to the prior art, in order to produce a band gap reference voltage of 1.21 volts, an operating supply voltage of 1.5 volts or greater is typically required in order to provide a margin of overhead. The majority of analog CMOS circuits today operate at a voltage of three (3) volts, which amply meets the needs of conventional bandgap circuits. However, advances in technology that have resulted in smaller and faster digital circuitry are pushing analog counterparts to keep pace. This, combined with a desire to reduce the voltage and current (i.e., power) requirements, is pushing analog circuitry to operate at voltages as low as one (1) volt, and perhaps even less than 1 volt. Quite obviously, this is less than the bandgap potential of 1.2 volts. As such, current bandgap circuits are not adequate in light of the desire to reduce the operating supply voltage to below the bandgap potential. Accordingly, what is needed is a circuit that can provide a stable reference voltage with an operating supply voltage less than the bandgap potential.

SUMMARY OF THE INVENTION

Embodiments of the present invention pertain to a circuit that provides a stable reference voltage with an operating supply voltage less than the bandgap potential and also less than a zero-bias threshold voltage. In one embodiment, the sub-bandgap circuit includes an operational amplifier having an N-well input stage and a proportional to absolute temperature (PTA) current source having a forward-biased P-bulk.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

An ultra-low power CMOS circuit that can provide a sub-bandgap reference voltage with a supply voltage less than the bandgap potential and a zero-bias threshold voltage (Vto) is described herein. In the following detailed description of the present invention, numerous specific details are set forth in order to provide a thorough understanding of the present invention. However, the present invention may be practiced without these specific details or by using alternate elements or methods. In other instances well known methods, procedures, components, and circuits have not been described in detail as not to unnecessarily obscure aspects of the present invention.

As an overview, in its various embodiments, the sub-band gap circuit of the present invention provides a stable reference voltage (plus/minus one percent, untrimmed) over process temperatures ranging from approximately −40° C. to 125° C. and voltages ranging from approximately 1.1 to 1.3 volts. According to these embodiments, the present invention sub-band gap circuit can be integrated with deep sub-micron (e.g., 0.12 micron) digital processes, while providing ultra-low power analog circuits in higher threshold CMOS processes generally used for power regulation and power management. In one embodiment, the sub-bandgap circuit comprises a 0.5-micron N-well CMOS with high threshold voltage (on the order of one volt) and high breakdown voltage (on the order of 5.5 volts).

Figure 1:
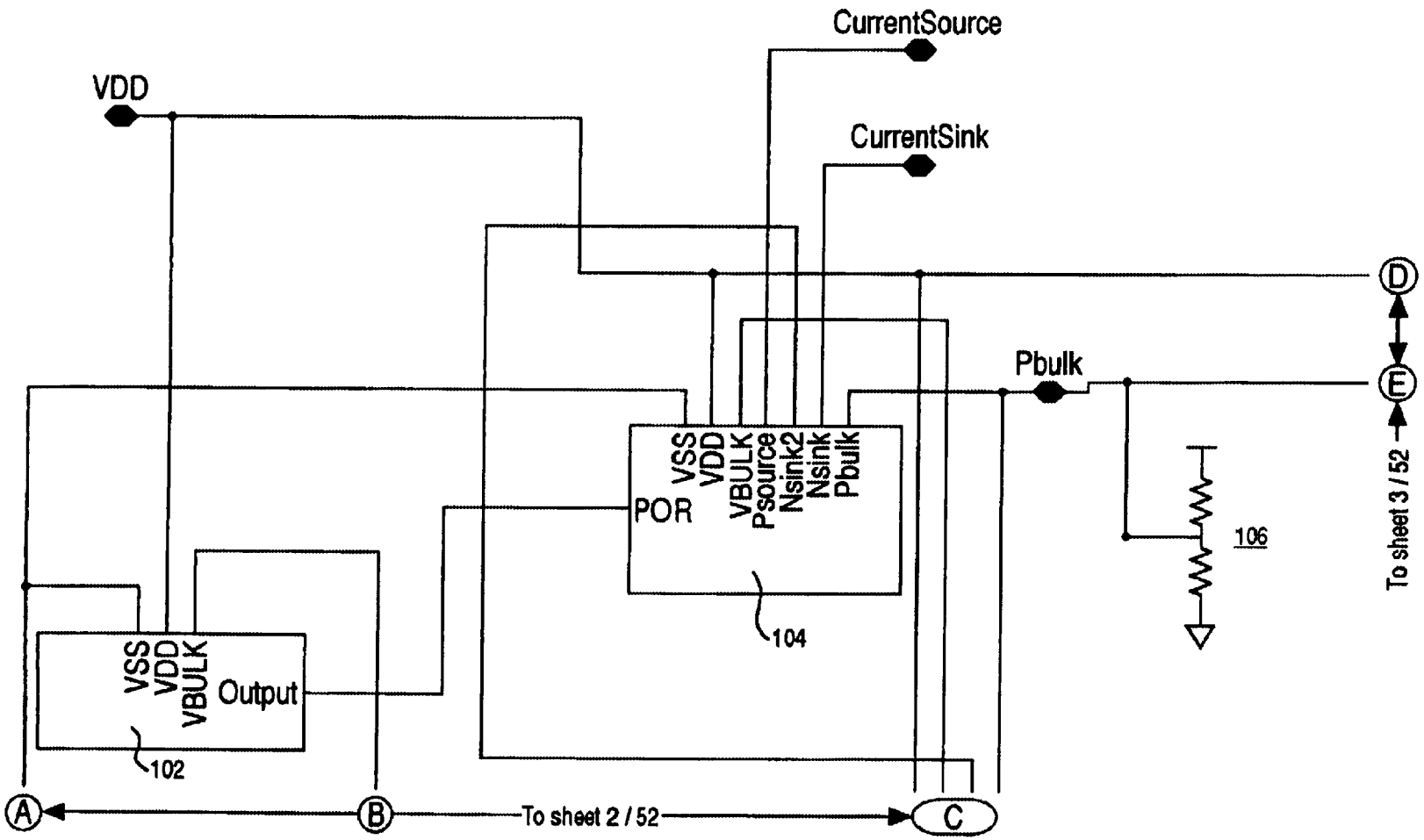
FIG. 1 is a schematic diagram of a sub-bandgap circuit according to one embodiment of the present invention.
Figure 1:
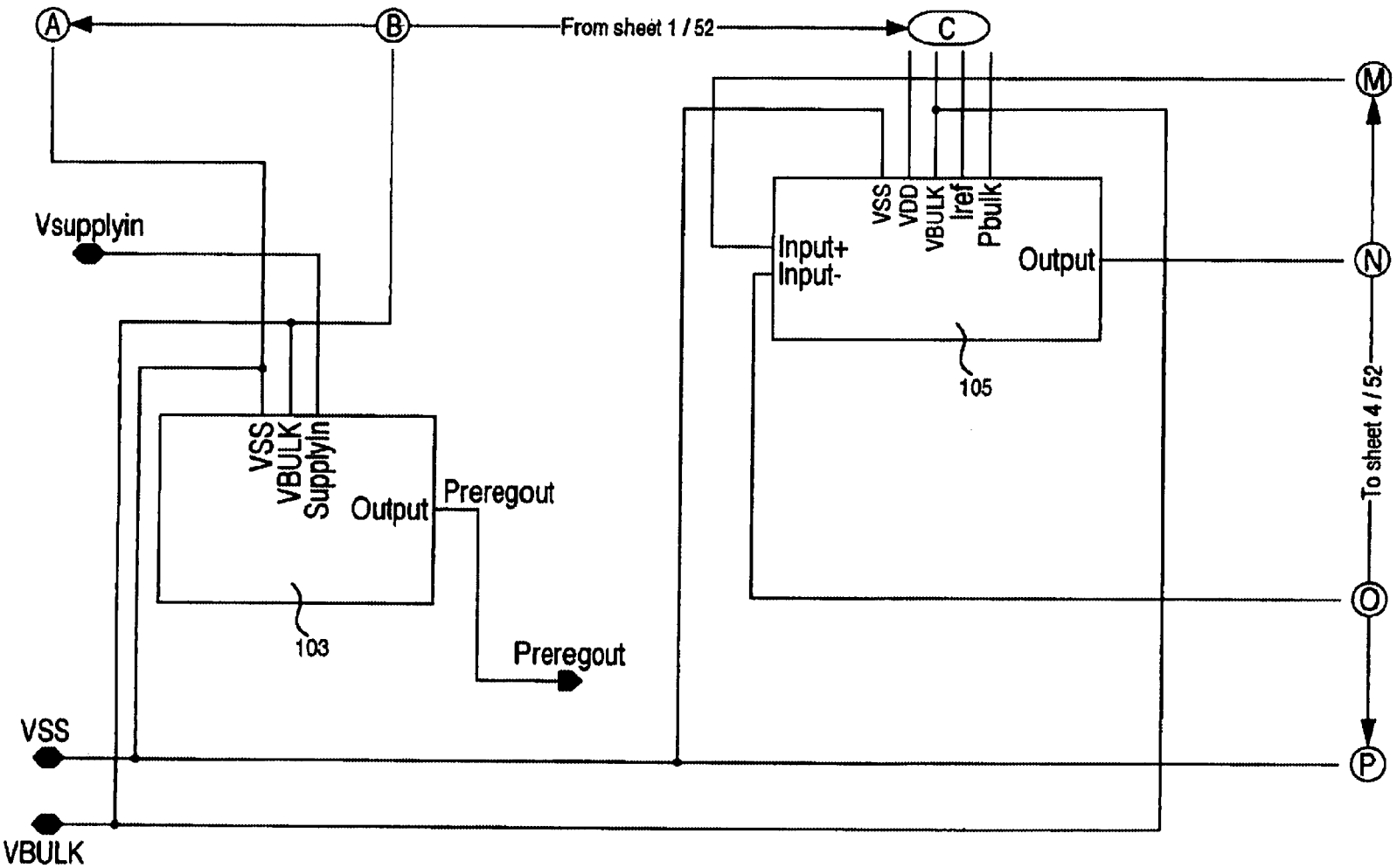
Figure 1:
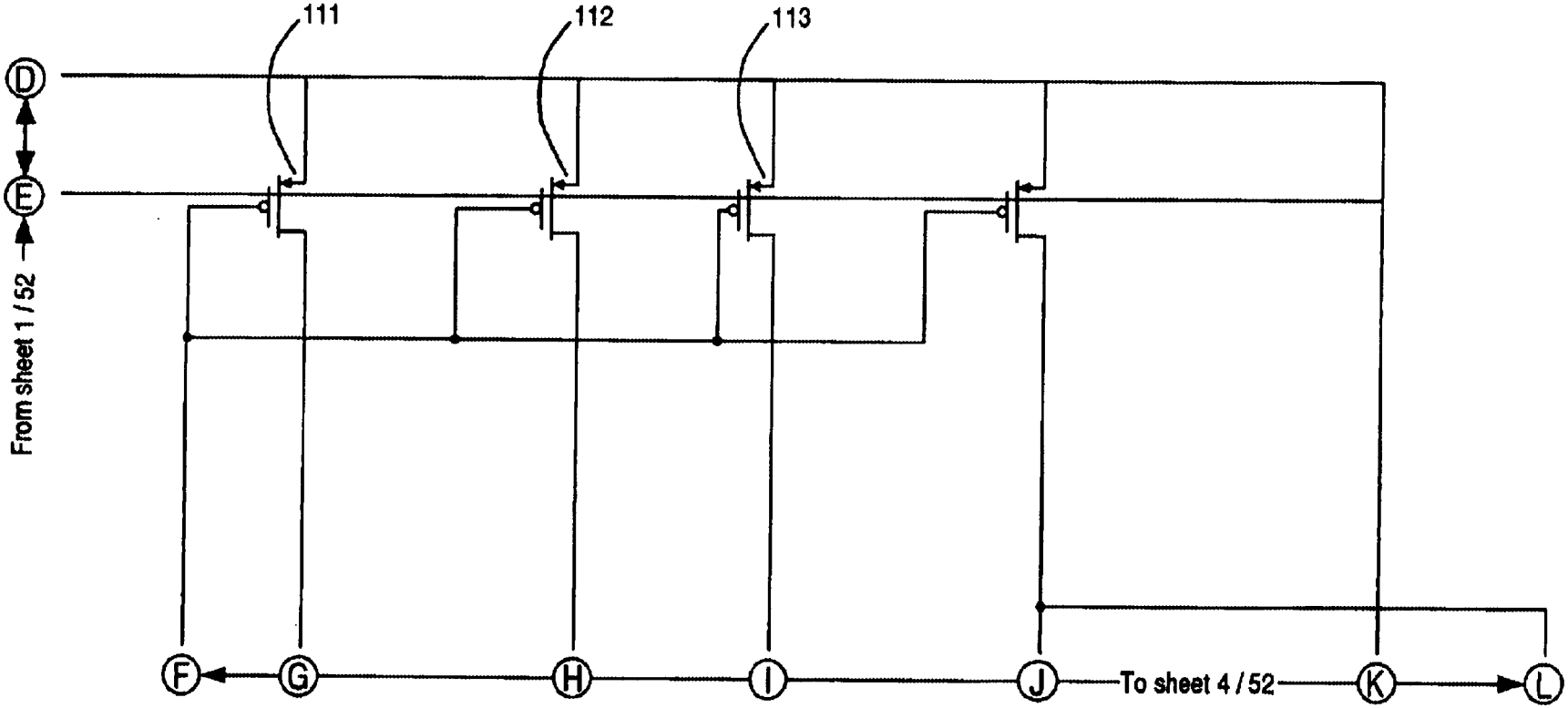
Figure 1:
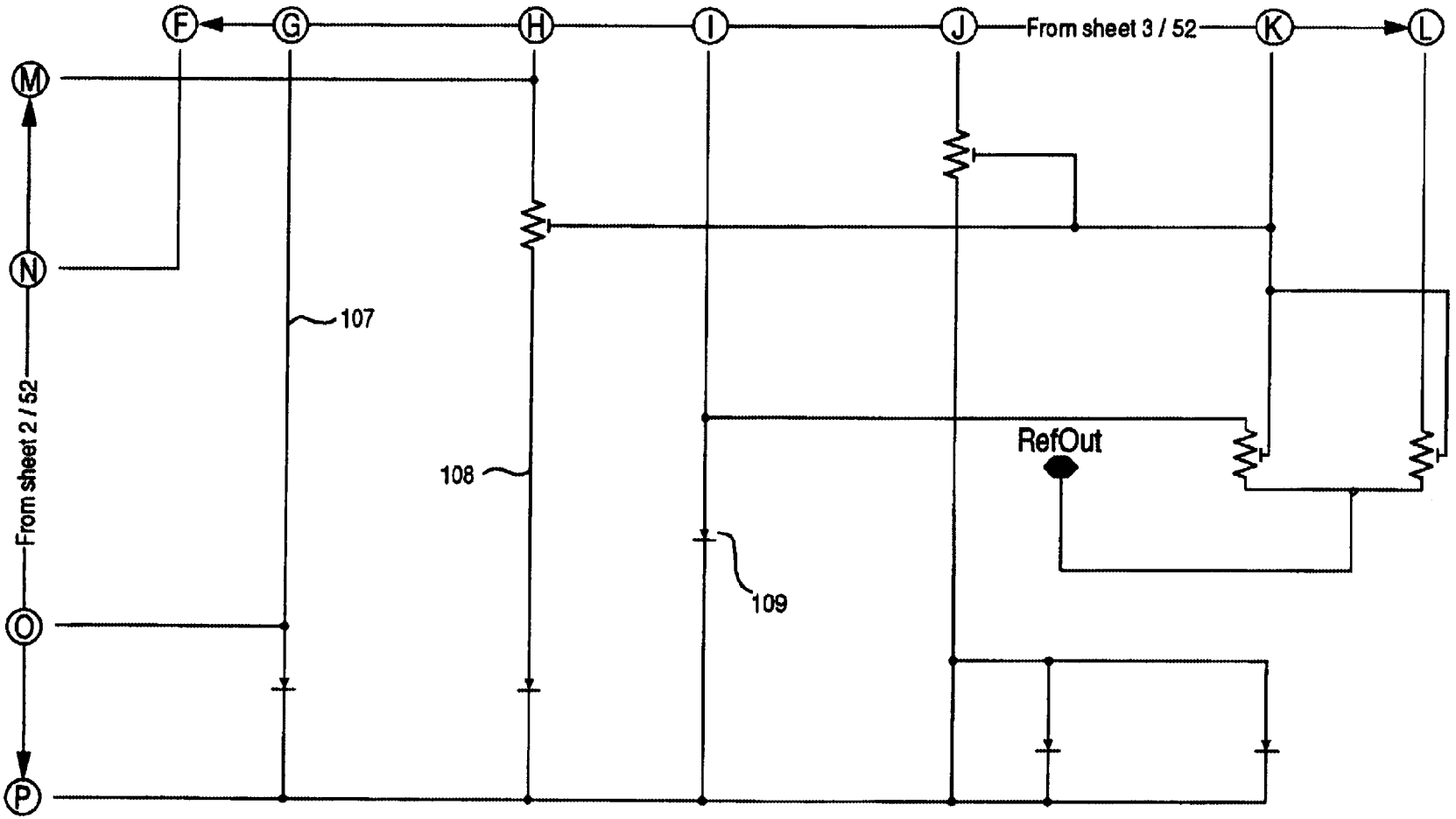

FIG. 1 shows a top-level schematic illustrating a sub-bandgap circuit 100 according to one embodiment of the present invention. In this embodiment, sub-bandgap circuit 100 includes a power-on reset (POR) block 102, a pre-regulator block 103, a current source block 104, and an operational amplifier block 105. In one embodiment, P-channel bulk (P-bulk) of the current source block 104 and the operational amplifier block 105 are coupled to an external resistor divider 106, comprising a pair of 1-Meg Ω resistors. The resistor divider potential lowers the effective threshold voltage (Vt) and thereby promotes lower voltage operation.

In the present embodiment, current mirroring is used in place of voltage gain to increase the starting diode voltage drop ΔVbe (the voltage between the base and the emitter) of the diodes in current legs 107 and 108. In this embodiment, a current leg 109 is included in addition to the current legs 107 and 108. Current legs 107 and 108 are "inside the loop," coupled to the input of operational amplifier 105 while being driven by the output of operational amplifier 105. Current leg 109 is "outside the loop," and compensates for stability problems that otherwise can be present in a circuit operating at voltages and powers as low as those being used by sub-bandgap circuit 100.

According to the present embodiment, a current mirroring gain of a factor of approximately six is achieved, bringing the starting ΔVbe up to about 100 milli-volts with a diode ratio approximately of eight-to-one on the current legs 107 and 108. The ΔVbe and the current legs 107 and 108 can be adjusted to have approximately the same current, which directly lends itself to resistor divider averaging.

A sub-bandgap develops a negative temperature coefficient by applying a constant temperature to a diode. The negative temperature coefficient is precisely canceled by the positive coefficient of a ΔVbe reference. Vbe is averaged with a multiplied version of the ΔVbe reference, both of which are about 0.612 volts or one-half of the bandgap potential (Vbg). Because the sum is constant, the average is constant if both voltages are equal (e.g., at room temperature). The averaging nature of this approach ((Vbe+ΔVbe·A)/2) reduces the sensitivity to manufacturing tolerances, resulting in an inherent improvement in yields and reduced sensitivities to process voltages and temperatures (PVT).

Also, the P-channel mirror devices 111, 112 and 113 can have their bulk node tied at a lower potential, on the order of one-half of VDD, reducing a normal P-channel threshold voltage of one volt to approximately 0.7 volts; this lower voltage can be used for all of the P-channel devices in the sub-bandgap circuit. Generally, for many CMOS processes, the N-channel threshold voltage is less than that of the P-channel. For N-channel devices, the threshold is lowered by minimizing channel length and sub-threshold current. N-channel devices having a large channel width in conjunction with minimal channel length can effectively lower the voltage threshold by about 200 milli-volts over Vto.

Figure 2:
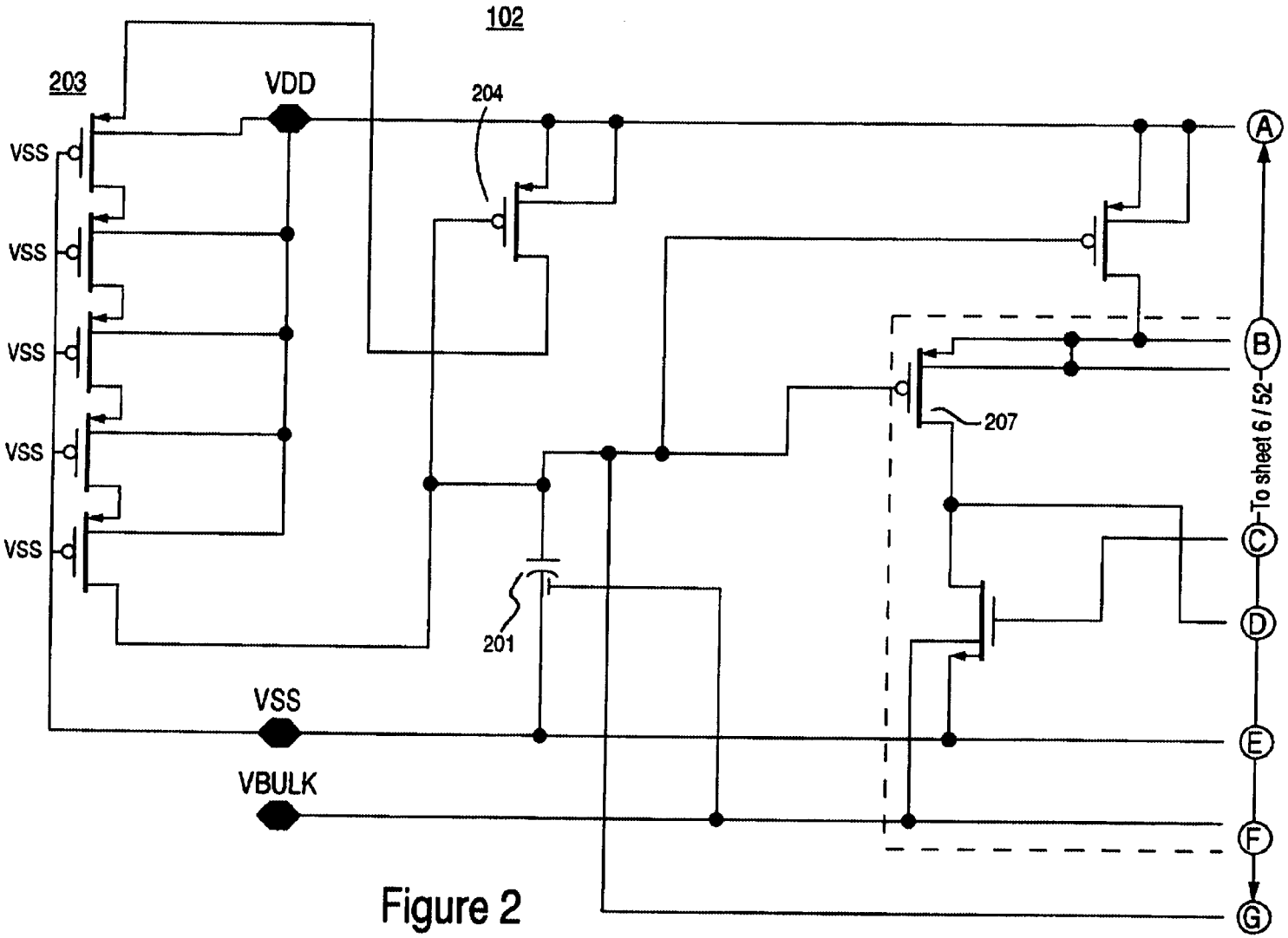
FIG. 2 is a schematic diagram of one embodiment of a power-on reset that may be implemented as part of the present invention.
Figure 2:
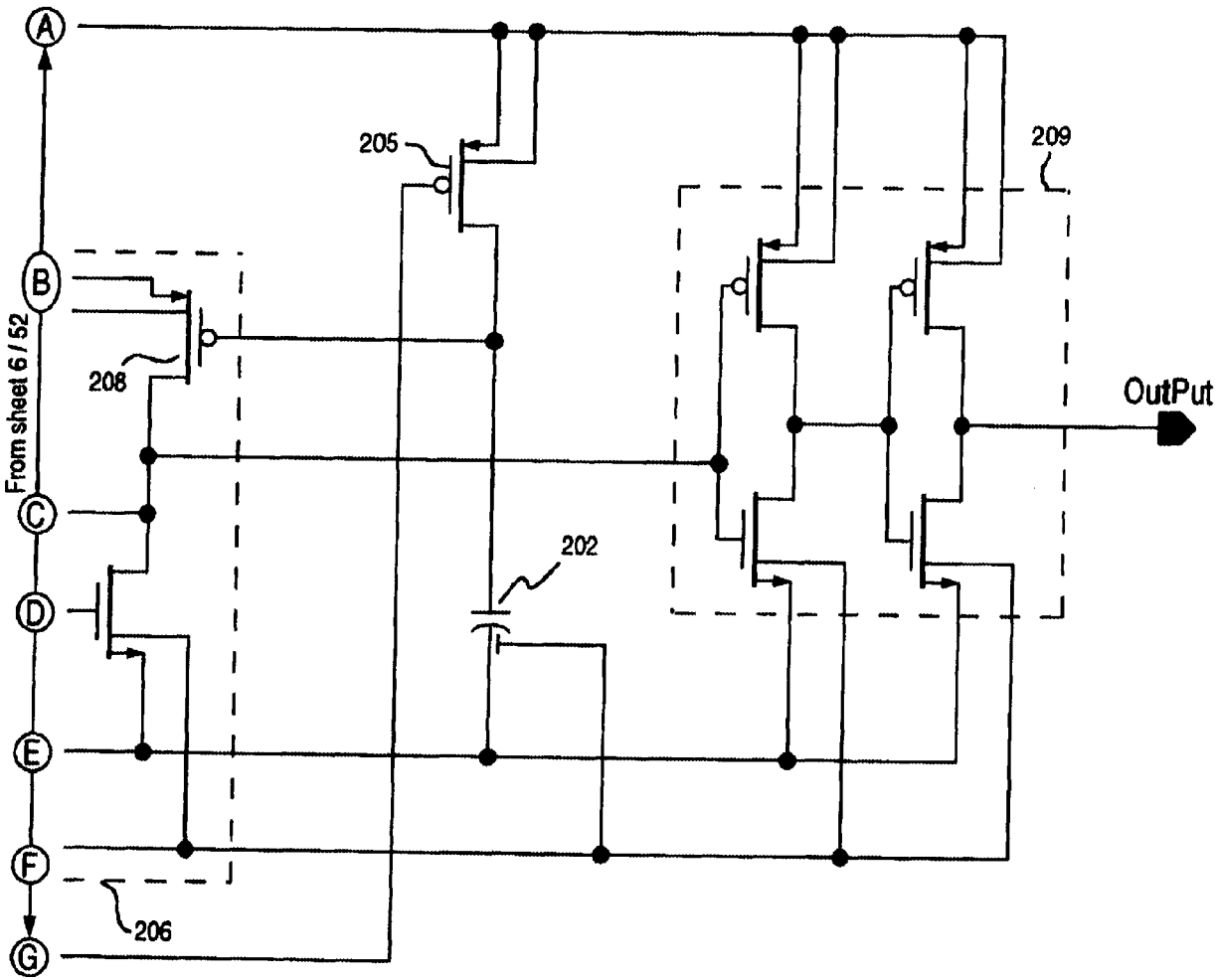

FIG. 2 is a schematic diagram of one embodiment of POR 102 that may be implemented as part of the present invention. POR 102 is used for system level reset and state initialization. POR 102 is a zero-current POR that promotes ultra-low voltage startup using a threshold and saturation voltage crossover scheme. It should be noted that POR 102 can feasibly operate to a 1-volt supply using conventional device operating regions. In the present embodiment, this is achieved using differentially charging capacitors 201 and 202 that have different turn-on thresholds; accordingly, there is no need for body biasing to Gmb (body transconductance) operation. In this embodiment, a first time constant is provided by the field effect transistors (FETs) 203 and 204 and capacitor 201, and a second, slower time constant is provided by FET 205 and capacitor 202. When the power supply comes up, a comparison between these two time constants determines when the power is high enough to ensure proper sub.-bandgap operation. A latch 206 is then triggered which pulls the sub-bandgap circuit 100 into its optimal operating range.

Once the sub-bandgap circuit 100 is reset, the latch 206 reverts to a standby mode. While in standby, the latch 206 consumes no current because the two P-channel transistors 207 and 208 are turned off, thereby promoting the extremely low power and current characteristics achieved in accordance with the present invention. Latch 206 stores states and is relatively immune to common mode noise sources such as supply glitches. A pair of inverters 209 is coupled to the output of latch 206.

Figure 3:
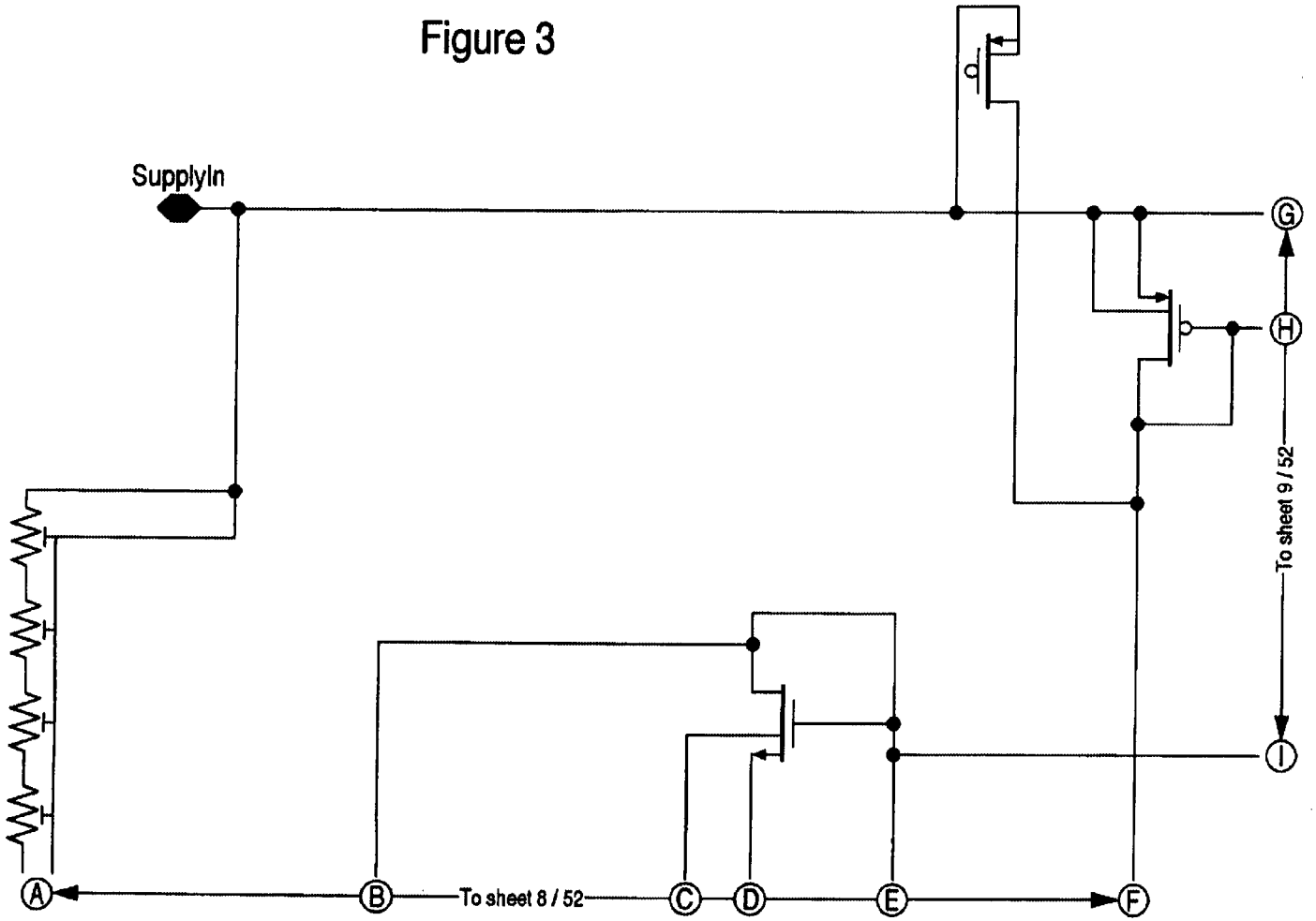
FIG. 3 is a schematic diagram of one embodiment of a pre-regulator that may be implemented as part of the present invention.
Figure 3:
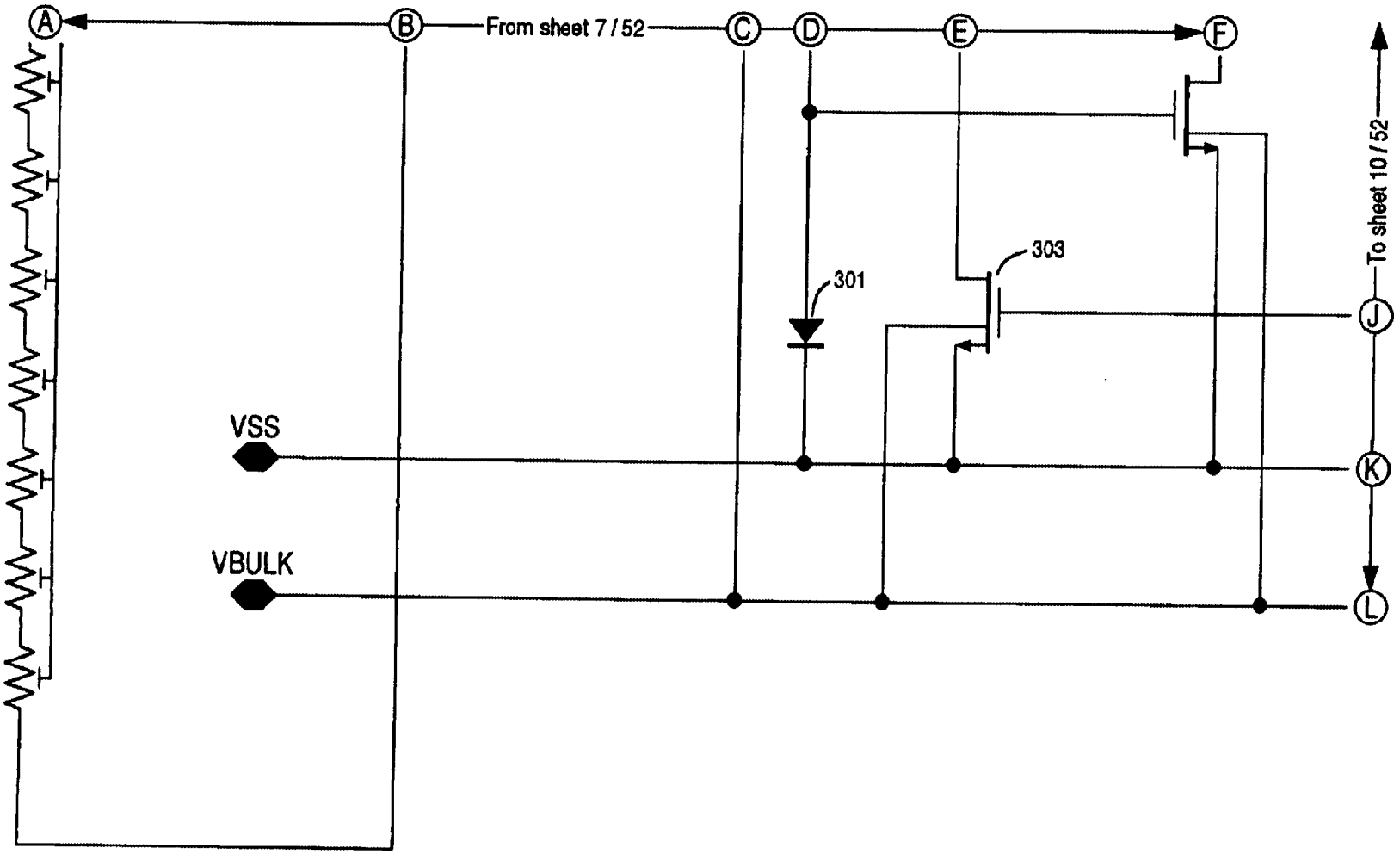
Figure 3:
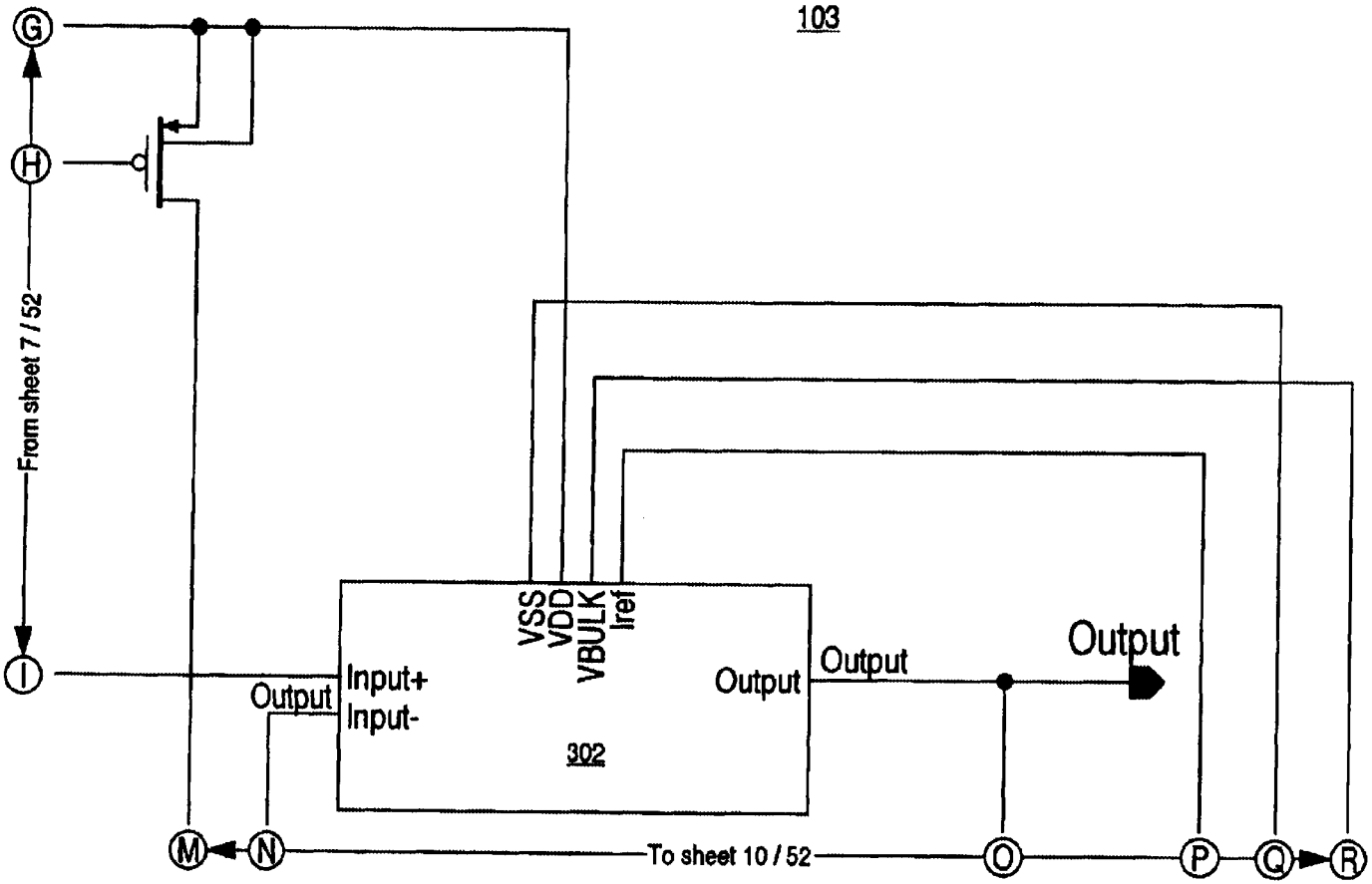
Figure 3:
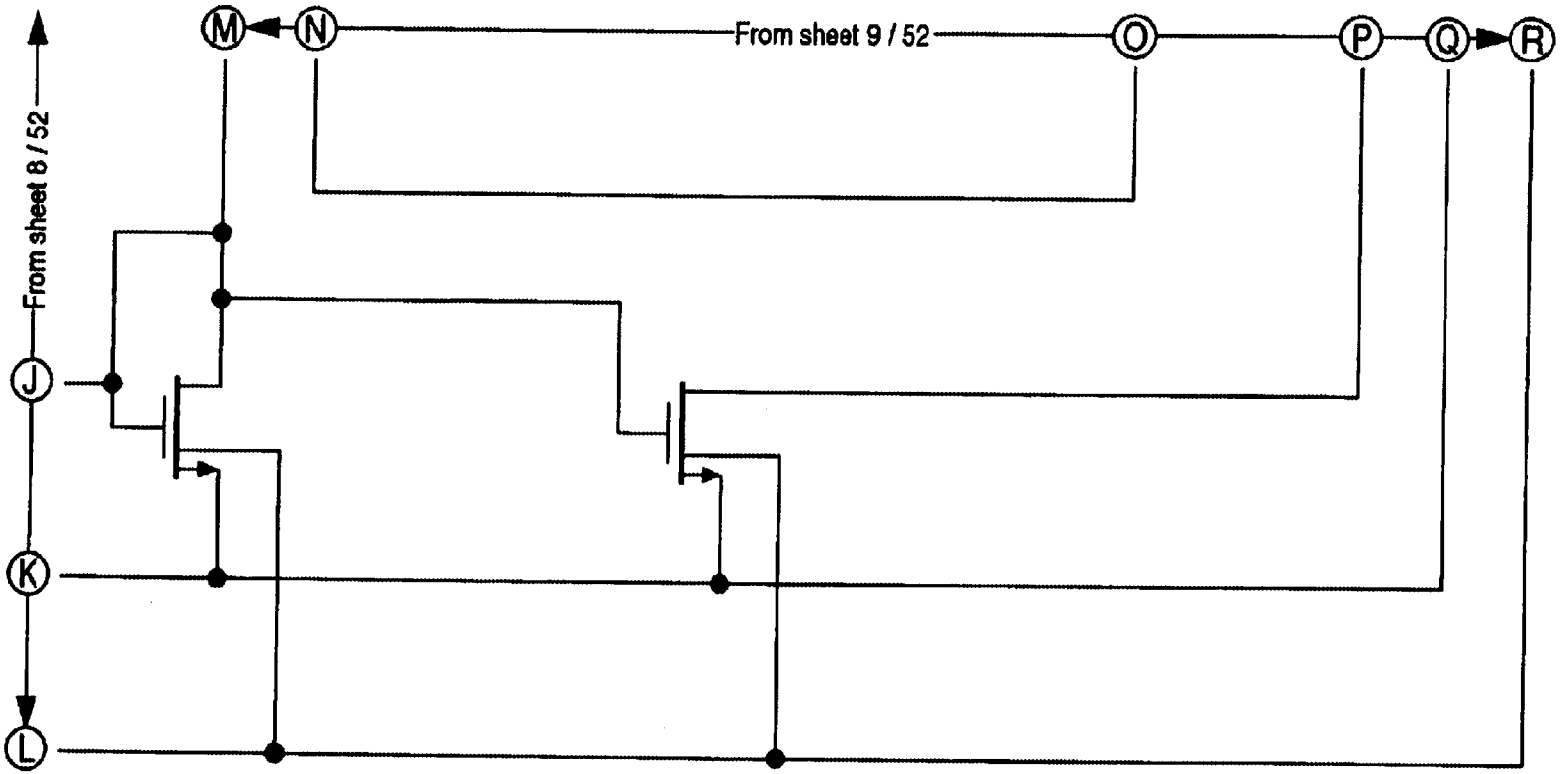

FIG. 3 is a schematic diagram of one embodiment of a pre-regulator 103 that may be implemented as part of the present invention. Pre-regulator 103 takes a voltage supply input (Vsupplyin) and regulates it down to a targeted voltage (Preregout). Pre-regulator 103 promotes operation of low voltage circuits up to 5.5 volts, which is typical of CMOS applications. In the present embodiment, pre-regulator 103 includes a current reference with voltage regulation based on a diode 301. In this embodiment, a stack-up of FETs and a unity gain amplifier 302 follow the reference. In addition, according to the present embodiment, temperature compensation is provided by FET 303. Thereby, the pre-regulator can regulate low voltage circuits (e.g., less than 5.5. volts) that may be used with CMOS applications. Also, pre-regulator 103 consumes less than 10 μA, which is significantly less than conventional designs which typically consume 100 μA or more. Pre-regulator 103 improves DC PSRR (the power supply rejection ratio) by more than 20 decibels (dB).

Figure 4:
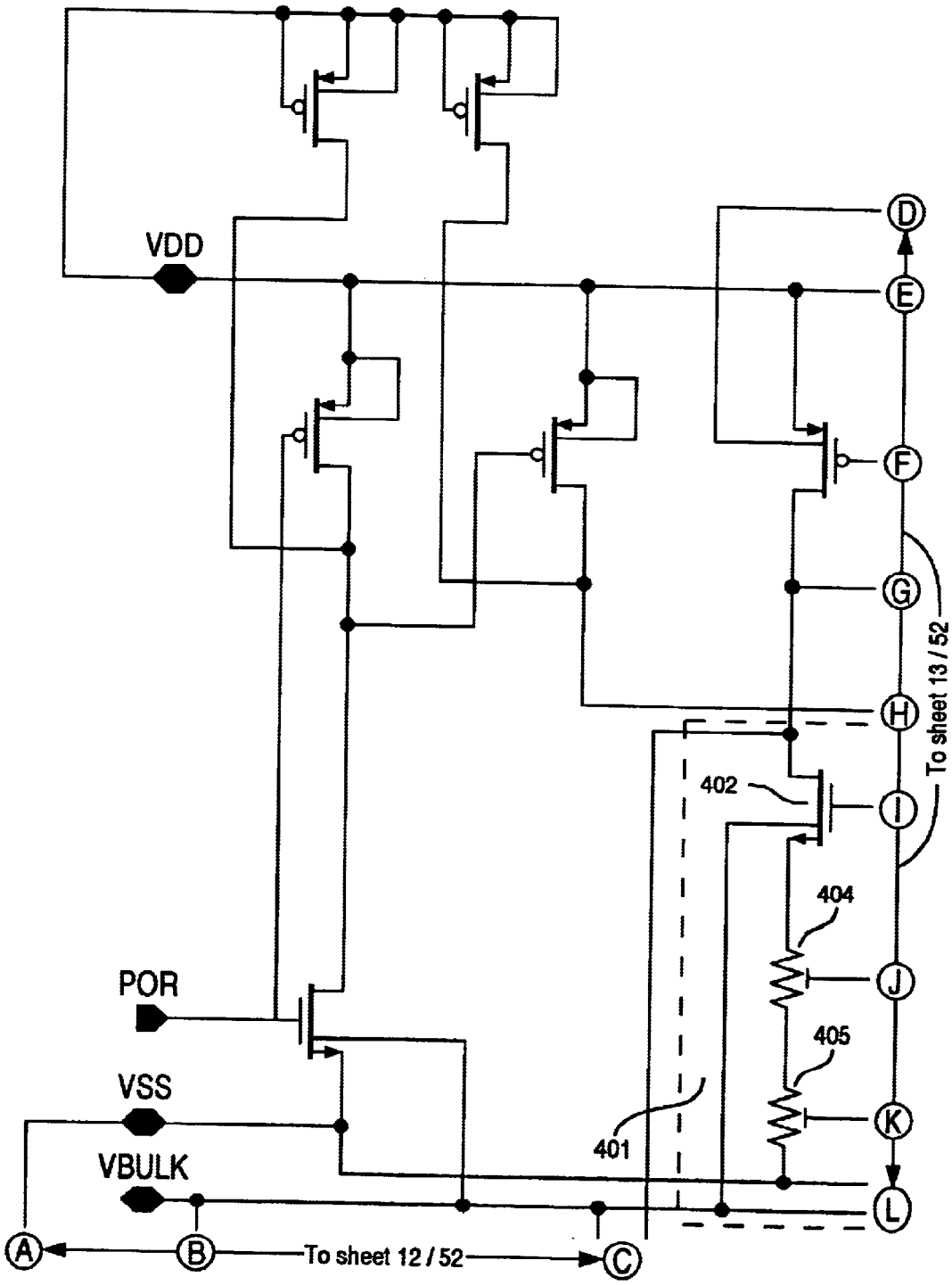
FIG. 4 is a schematic diagram of one embodiment of a current source that may be implemented as part of the present invention.
Figure 4:
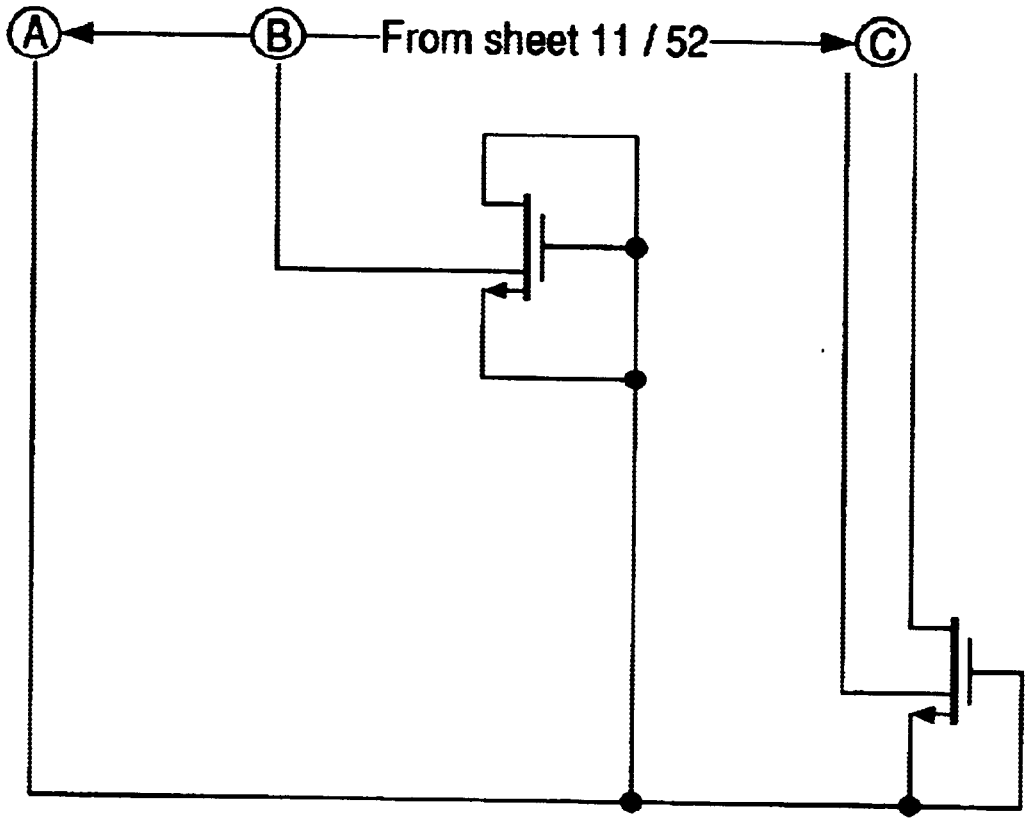
Figure 4:
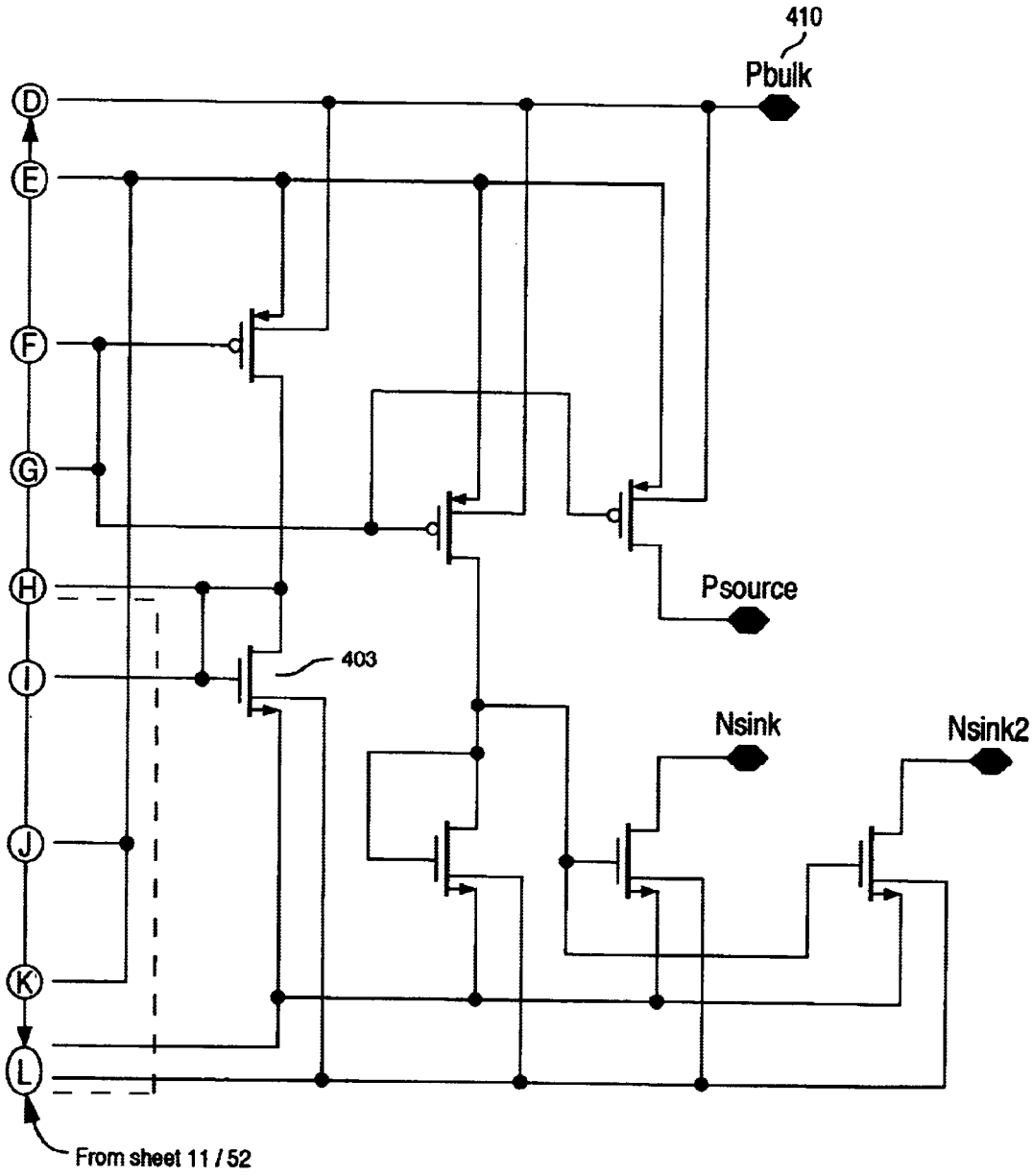

FIG. 4 is a schematic diagram of one embodiment of a current source 104 that may be implemented as part of the present invention. This current source provides an accurate supply-independent current source, to voltages at least as low as approximately one volt. In the present embodiment, current source 104 incorporates a PTA (proportional to absolute temperature) Vittoz source 401. Utilization of the PTA current effectively compensates for process and temperature effects normally associated with sub-threshold operation. In one embodiment, sub-threshold current biases that track the normal variations in process and temperature are applied. In one embodiment, a PTA current of 640 nano-amps is used.

In one embodiment, an area ratio of four-to-one is selected for N-channel transistors 402 and 403 to provide sufficient loop gain with relatively low resistor values. In this embodiment, the channel width of transistor 402 is 120μ, the channel width of transistor 403 is 30μ, resistor 404 is approximately 50 KΩ, and resistor 405 is approximately 150 KΩ.

Of significance, according to the present embodiment of the present invention, the P-channel bodies (P-bulk 410) in the current source are forward-biased. This reduces the effect of high threshold voltage in the weak inversion region of operation. For a P-channel FET in an N-well process, the bulk (or body) can be used as an input control node. With the gate tied to ground (e.g., with the device on all the time), the bulk can be used as an input port because the source is reverse-biased or only slightly forward-biased. This mode of operation has gain that is based on Gmb instead of on Gm (the "short circuit" transconductance). For most processes, this conductance is a factor of about ten lower for a given current; however, in one embodiment, folded cascading techniques are used to provide two-stage gains in excess of 90 dB with a supply operating voltage below the threshold voltage. This mode of operation can reduce bandwidth and drive capability; however, the decreased:; bandwidth can be beneficial because it results in lower noise bandwidth, so that operational amplifier 105 (FIG. 1) can actually serve as a noise filter. Furthermore, techniques such as double-correlated sampling and chopper averaging can be used effectively to reduce noise.

Figure 5:
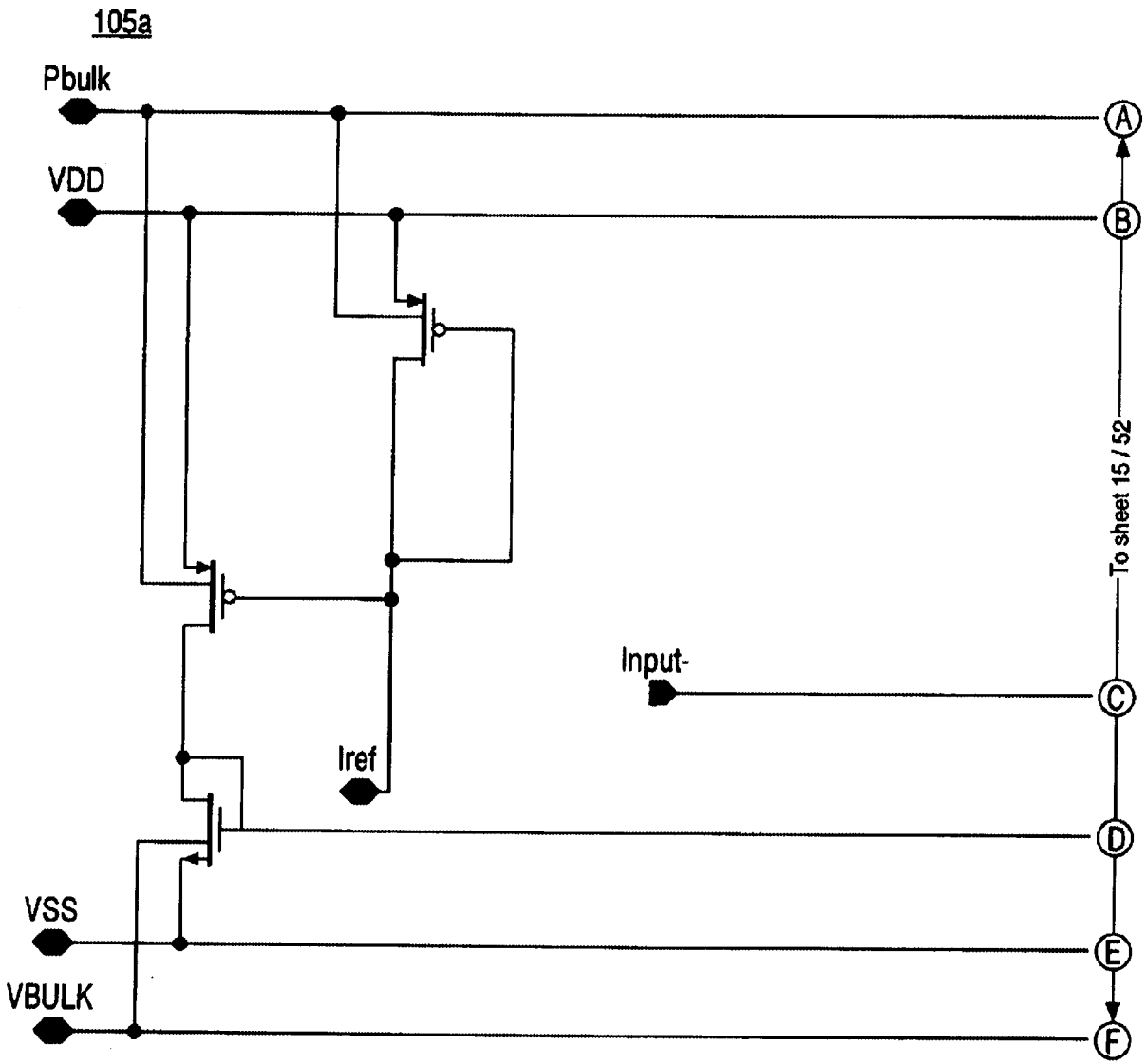
FIG. 5 is a schematic diagram of one embodiment of an operational amplifier that may be implemented as part of the present invention.
Figure 5:
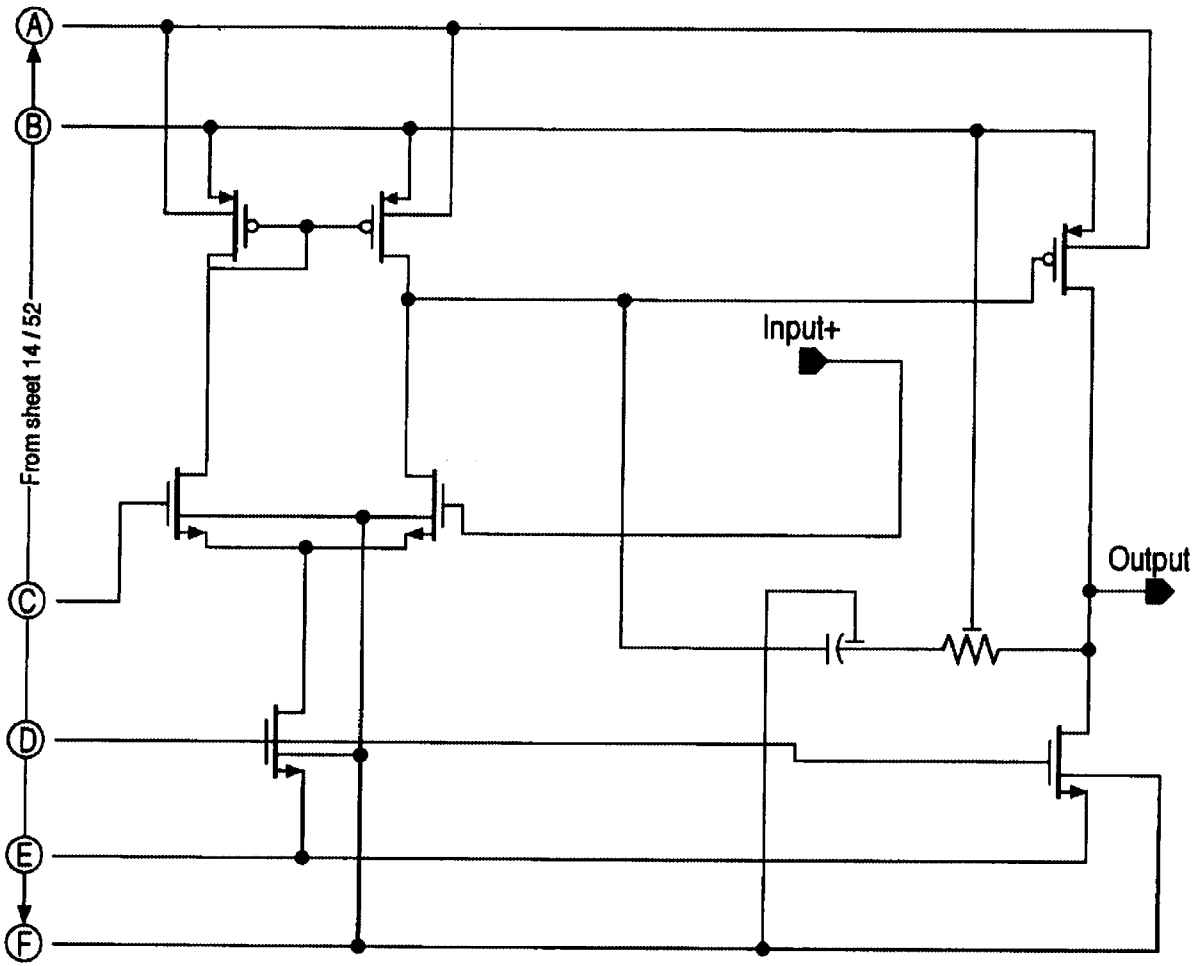
Figure 9:
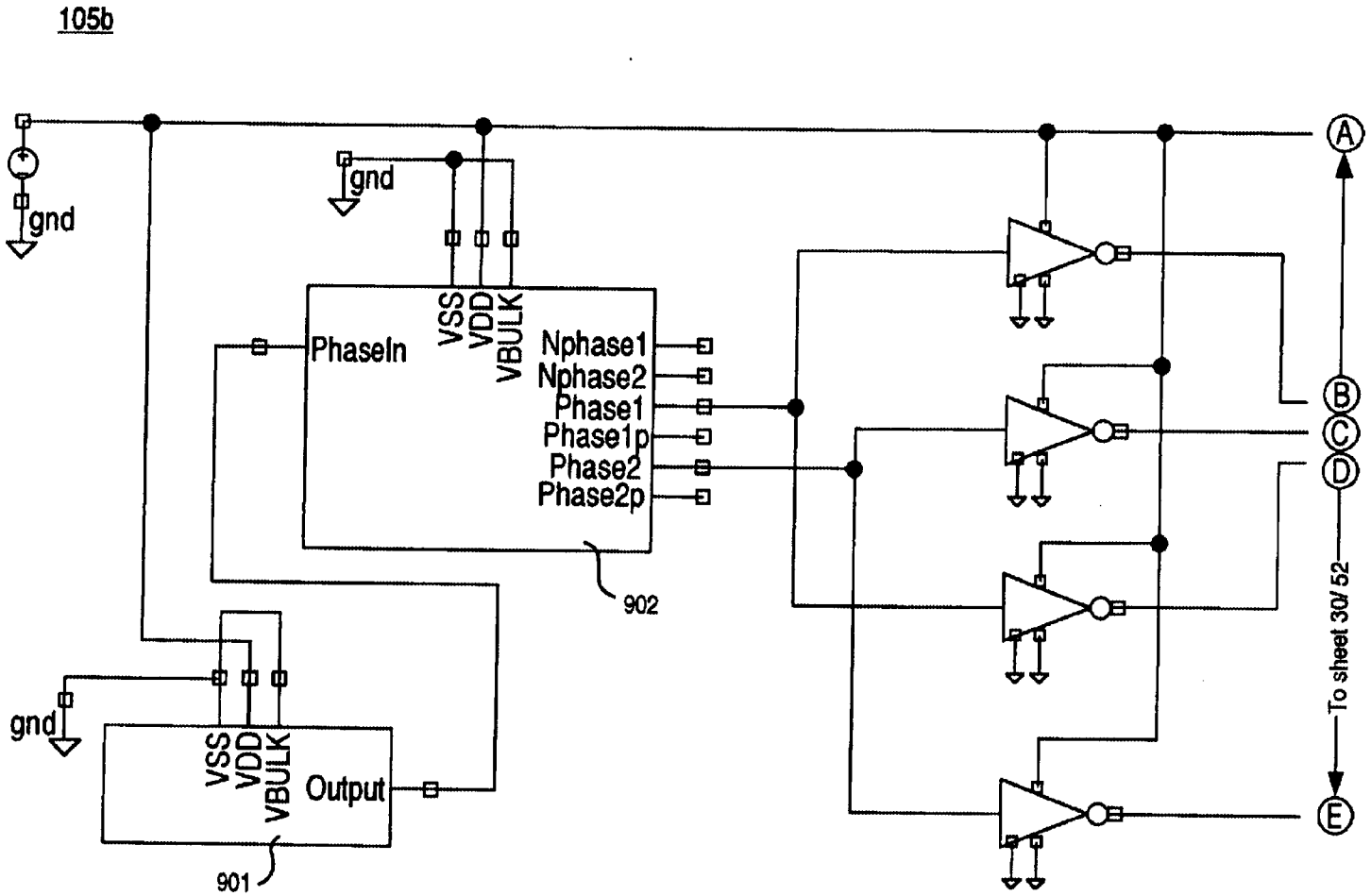
FIG. 9 is a schematic diagram of another embodiment of an operational amplifier that may be implemented as part of the present invention.
Figure 9:
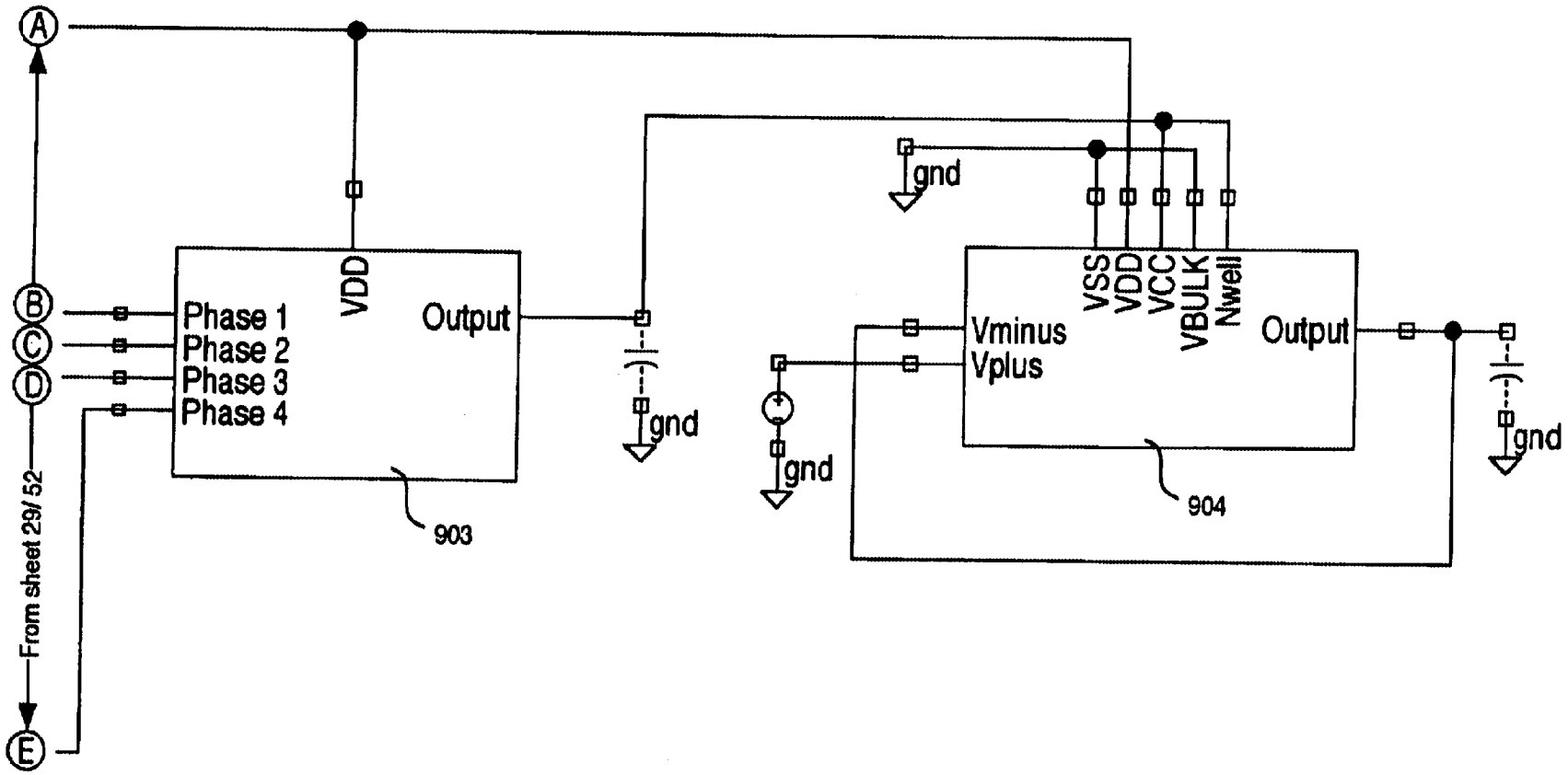

FIG. 5 is a schematic diagram of one embodiment of an operational amplifier (op-amp) 105*a* that may be implemented as part of the present invention. Another embodiment of an op-amp (105*b*) that may be implemented as part of the present invention is illustrated in FIG. 9. It should be mentioned that, in some applications, lower performance amplifiers can be used, resulting in area savings and reduced design risk. That is, different amplifiers can be selected for use depending on the application of the sub-band gap circuit.

Generally speaking, it is desirable to increase the DC loop gain to the greatest extent possible because an error in this gain translates directly into offset error. Also, because absolute gain may not be adequately controlled over PVT, excess gain may be required. In the present embodiment, an N-channel input stage, operating in the sub-threshold region, is used because it provides added robustness for process voltage and temperature effects relative to a P-channel input stage. However, a P-channel input stage can provide advantages over an N-channel input stage, depending on the starting point of the processes. It should be noted that, in many CMOS applications, the thresholds of the N-channel and P-channel are asymmetric, with the threshold of the N-channel generally lower than that of the P-channel. In a symmetric threshold process, a P-channel input stage is expected to be advantageous.

Figure 6:
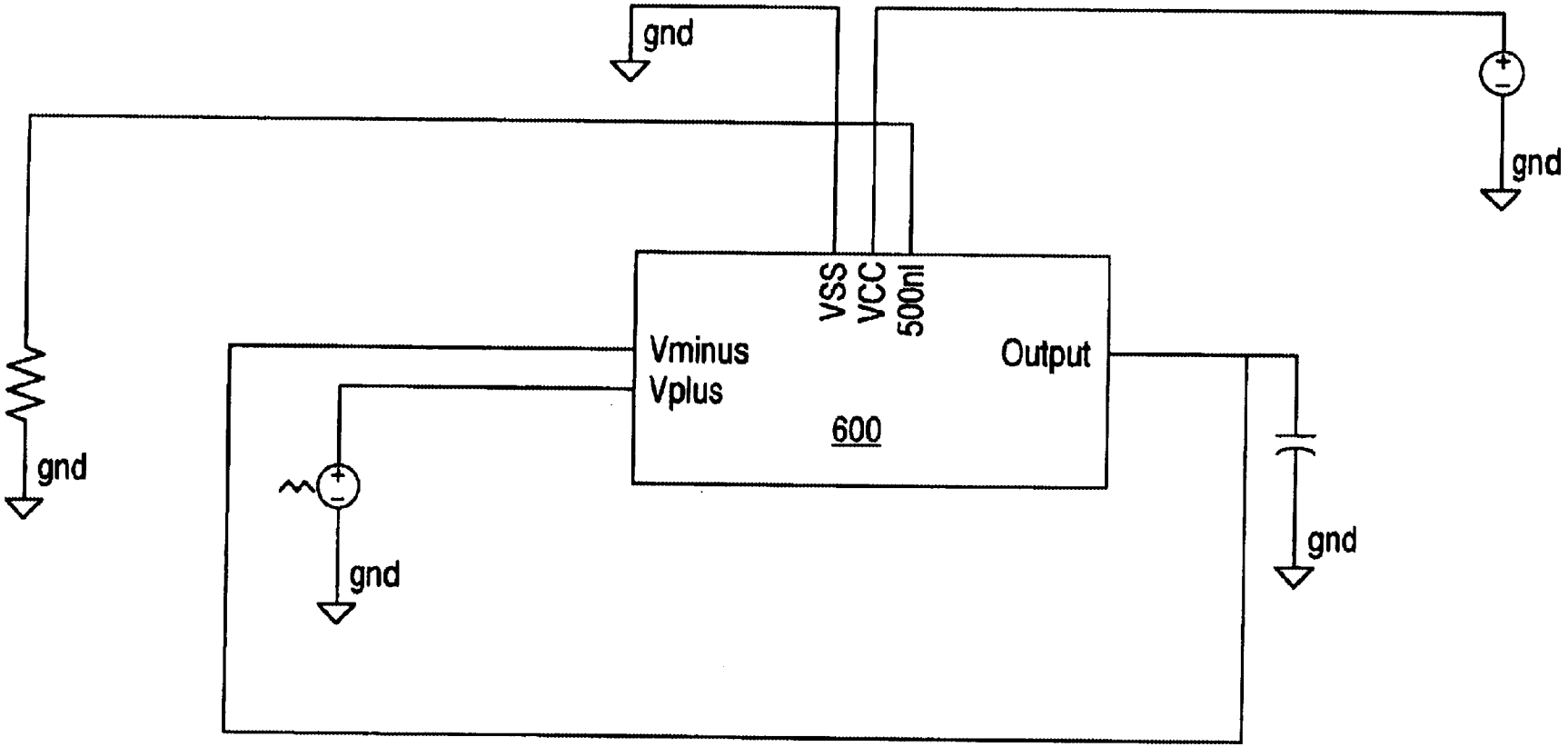
FIG. 6 is a schematic diagram of one embodiment of an input stage for the operational amplifier of FIG. 5 that may be implemented as part of the present invention.

FIG. 6 is a schematic diagram of one embodiment of an input stage 600 for the operational amplifier of FIG. 5 that may be implemented as part of the present invention. Input stage 600 is Gmb-based and provides a DC gain of over 90 dB.

Figure 7:
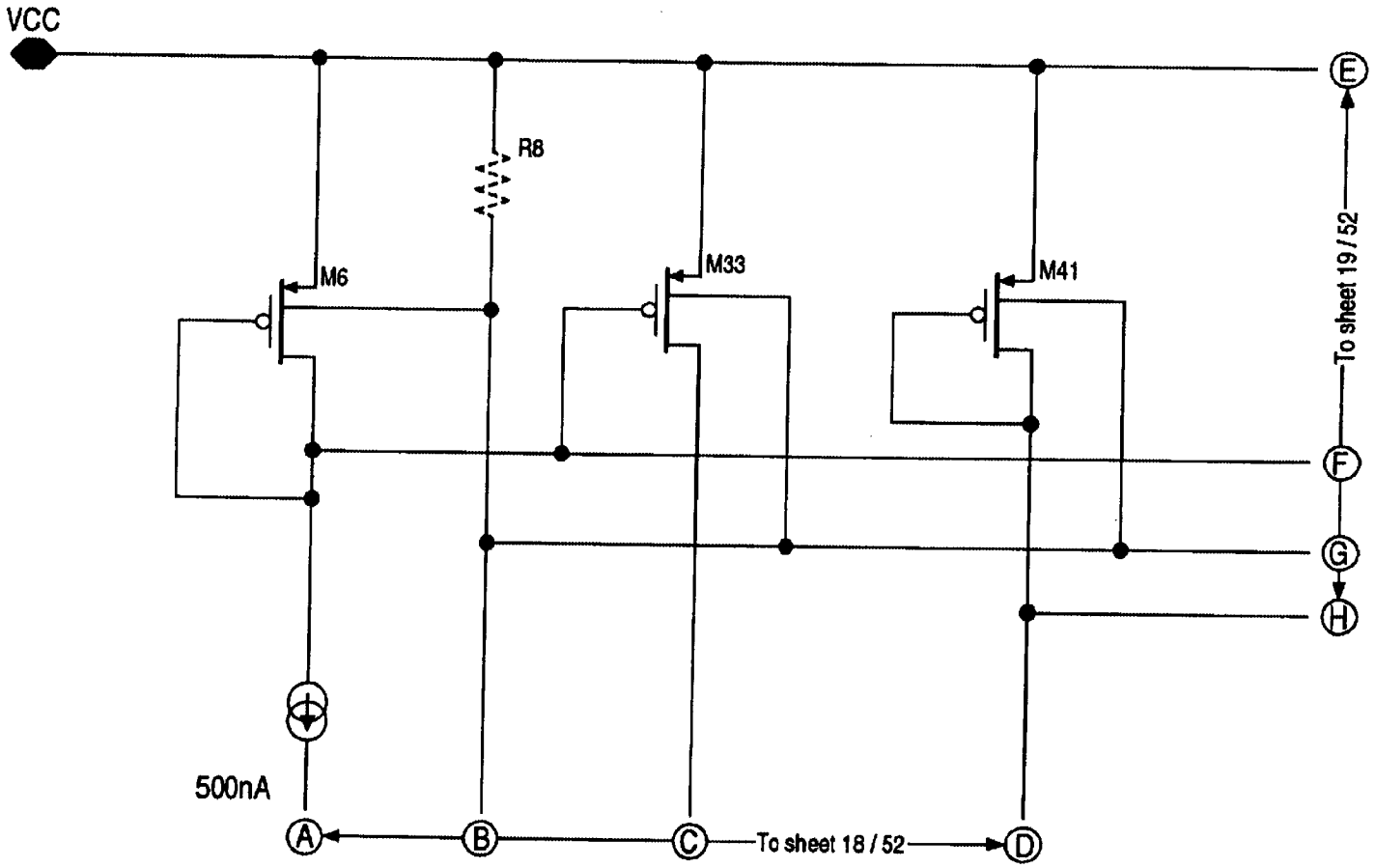
FIG. 7 is a schematic diagram further illustrating one embodiment of an input stage for the operational amplifier of FIG. 5 that may be implemented as part of the present invention.
Figure 7:
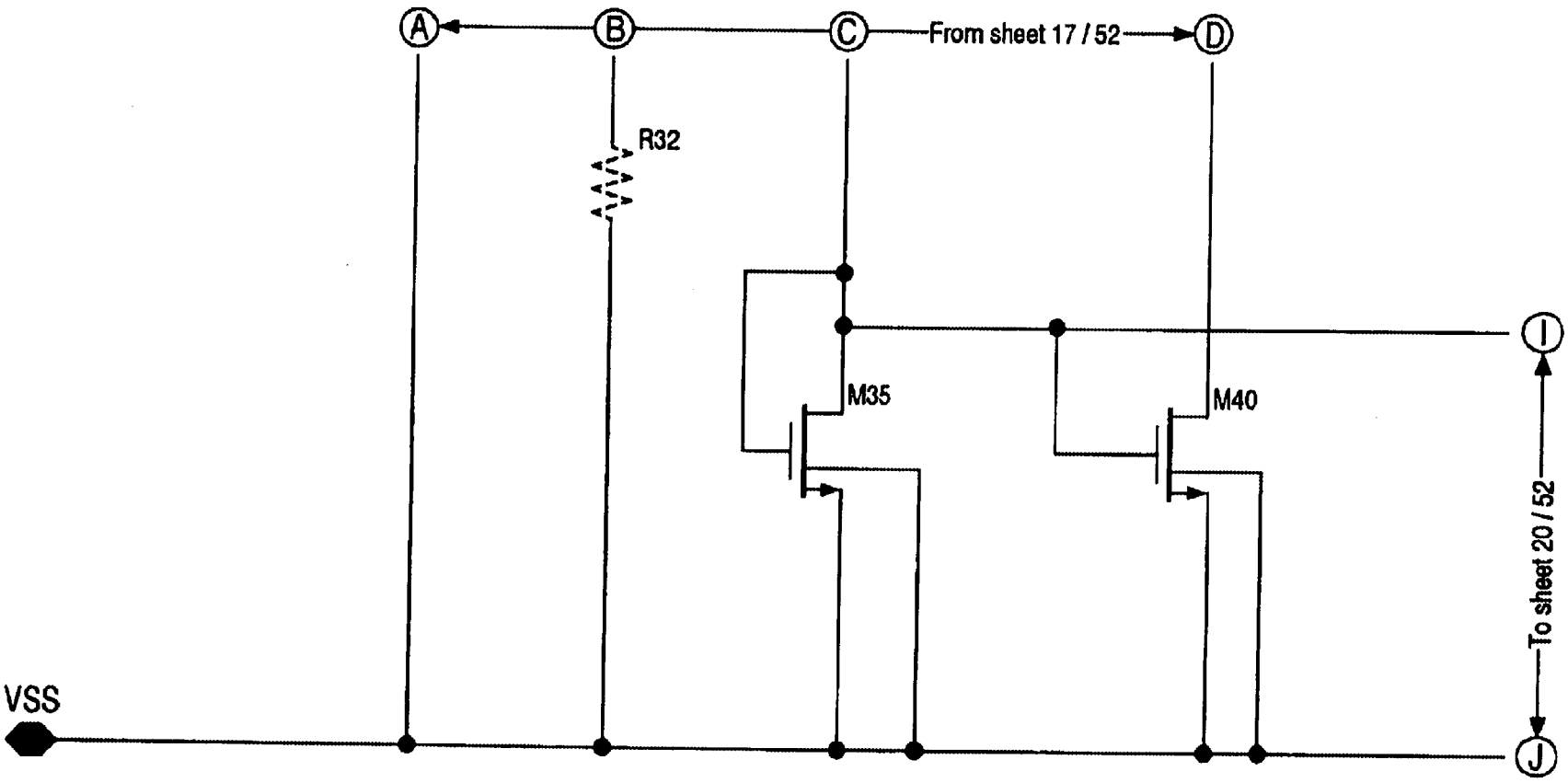
Figure 7:
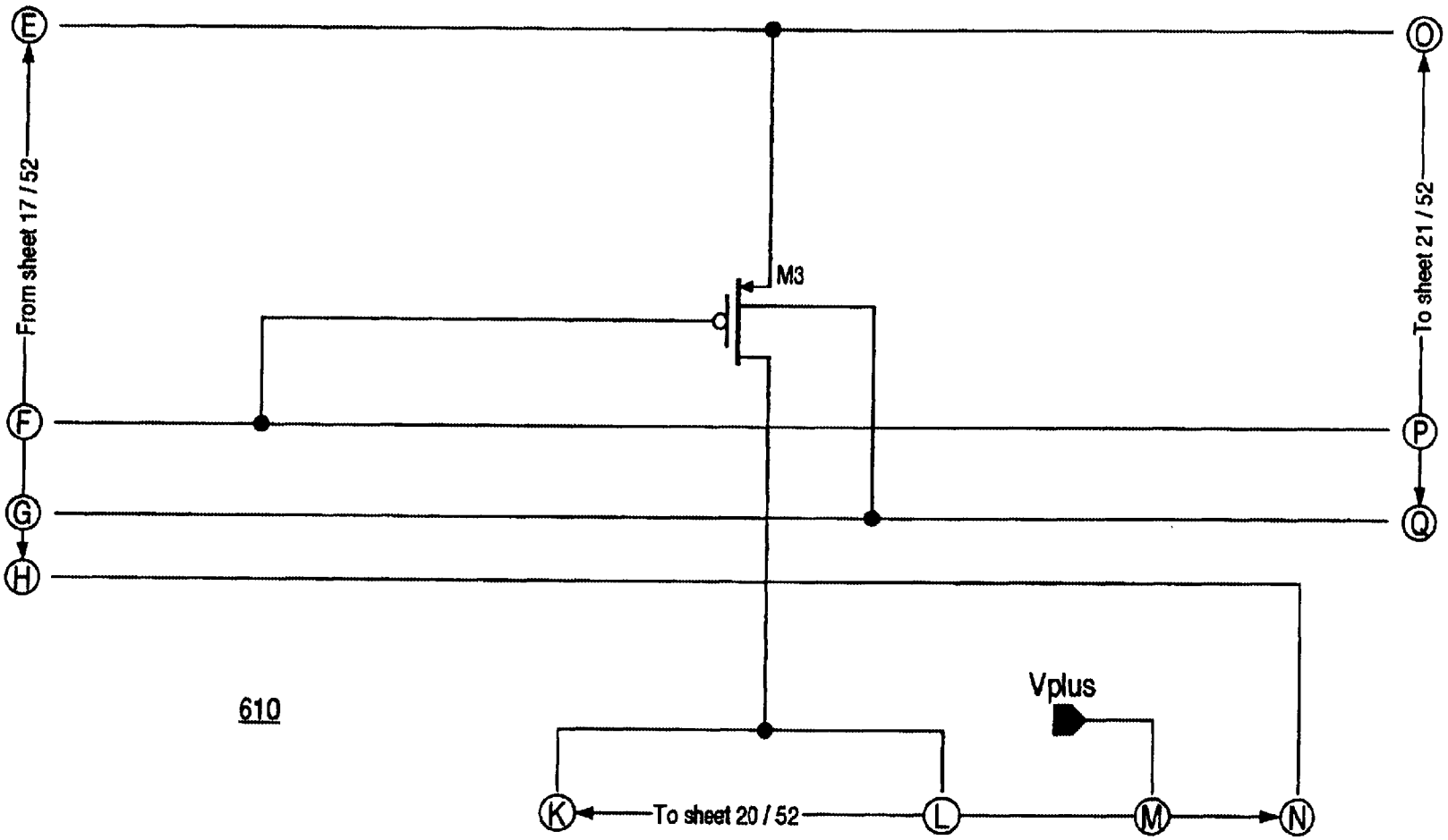
Figure 7:
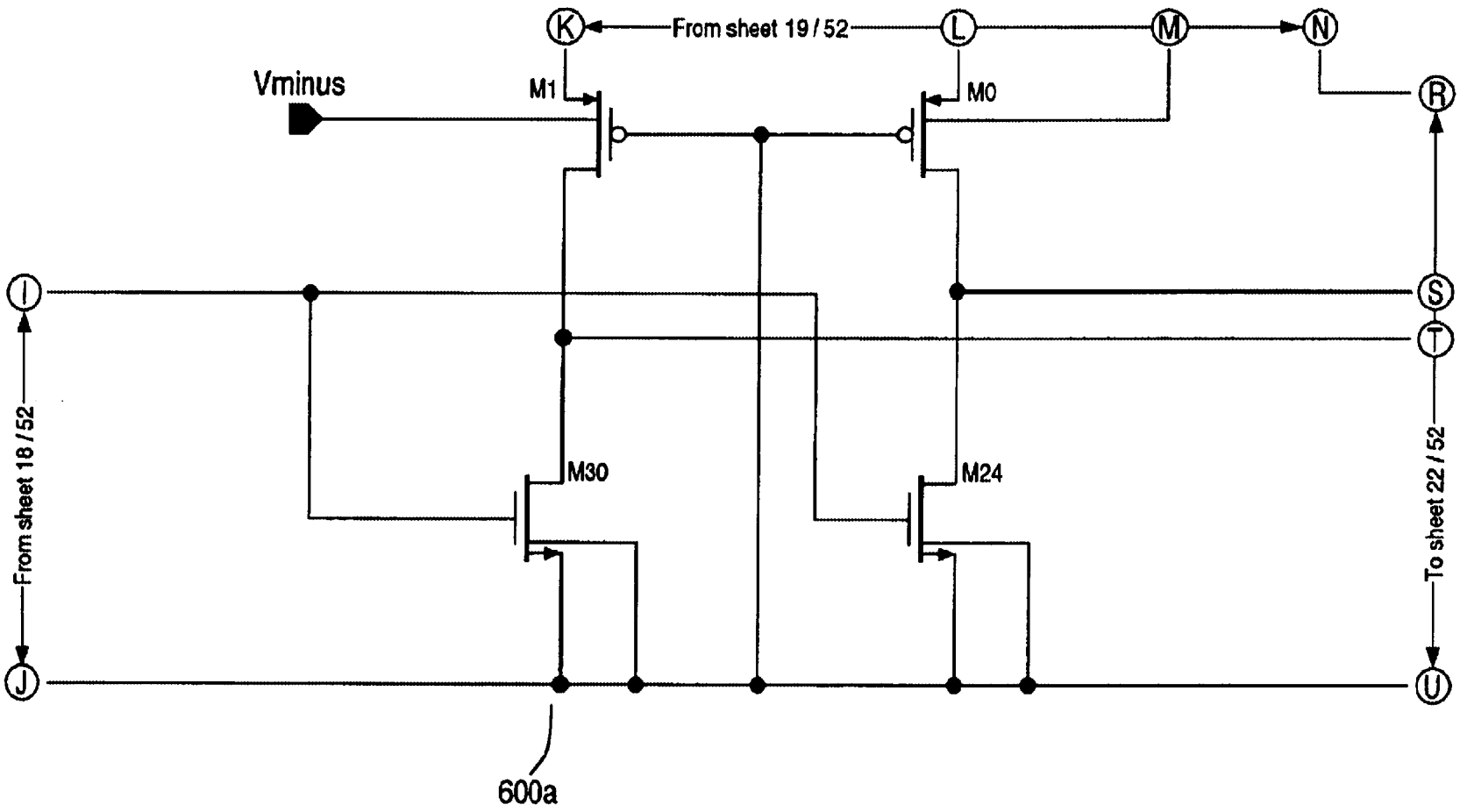
Figure 7:
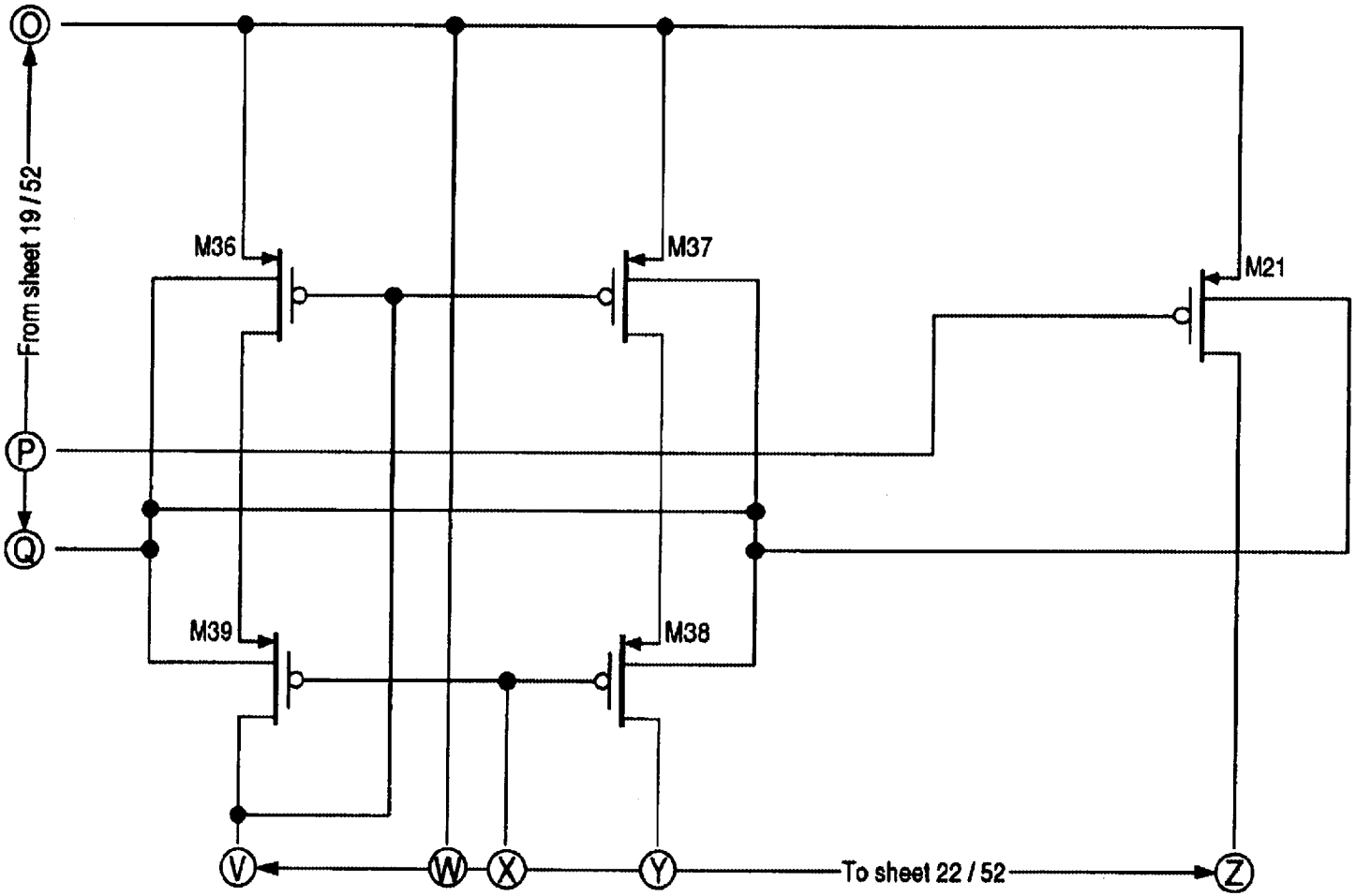
Figure 7:
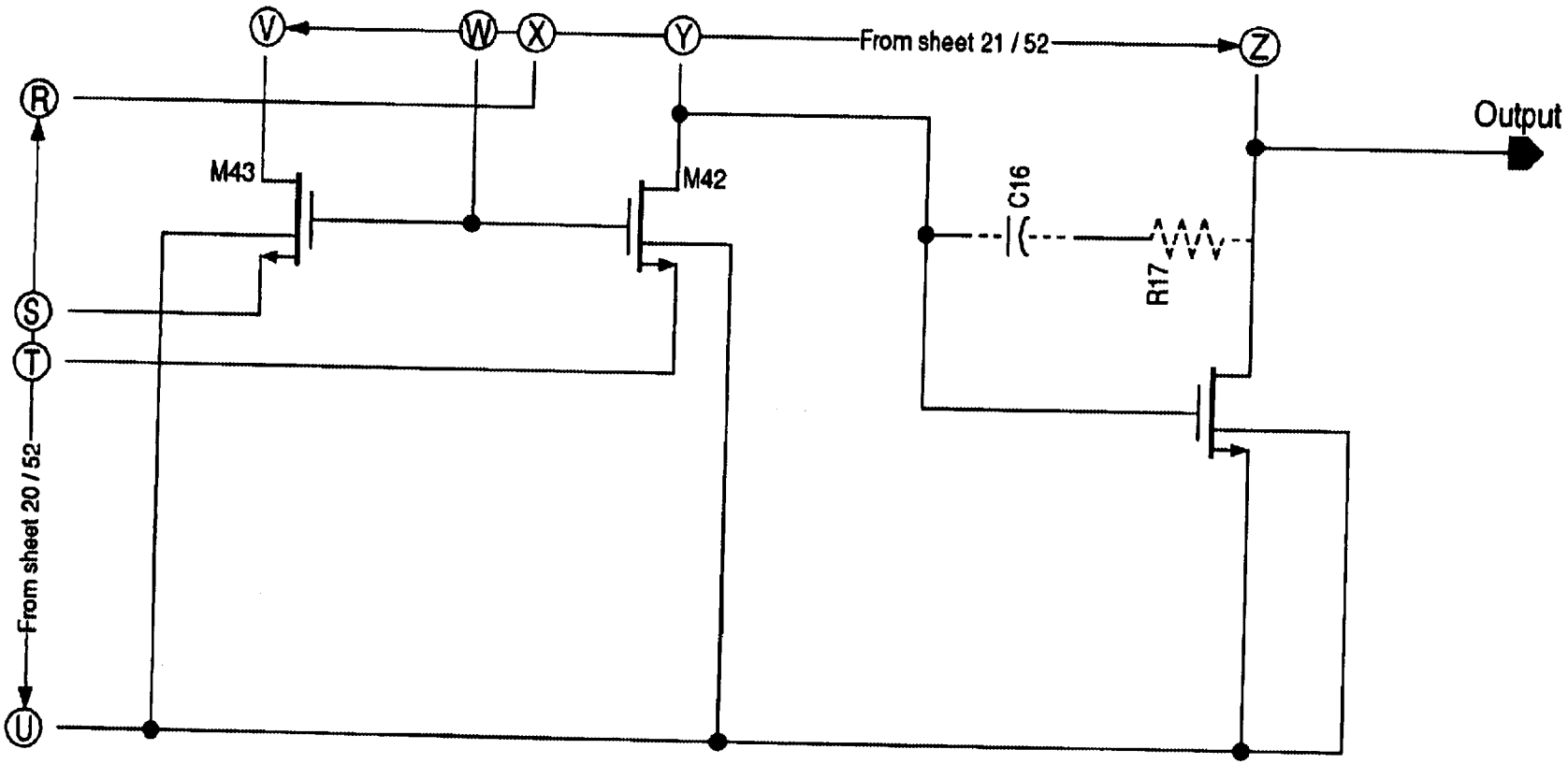
Figure 8:
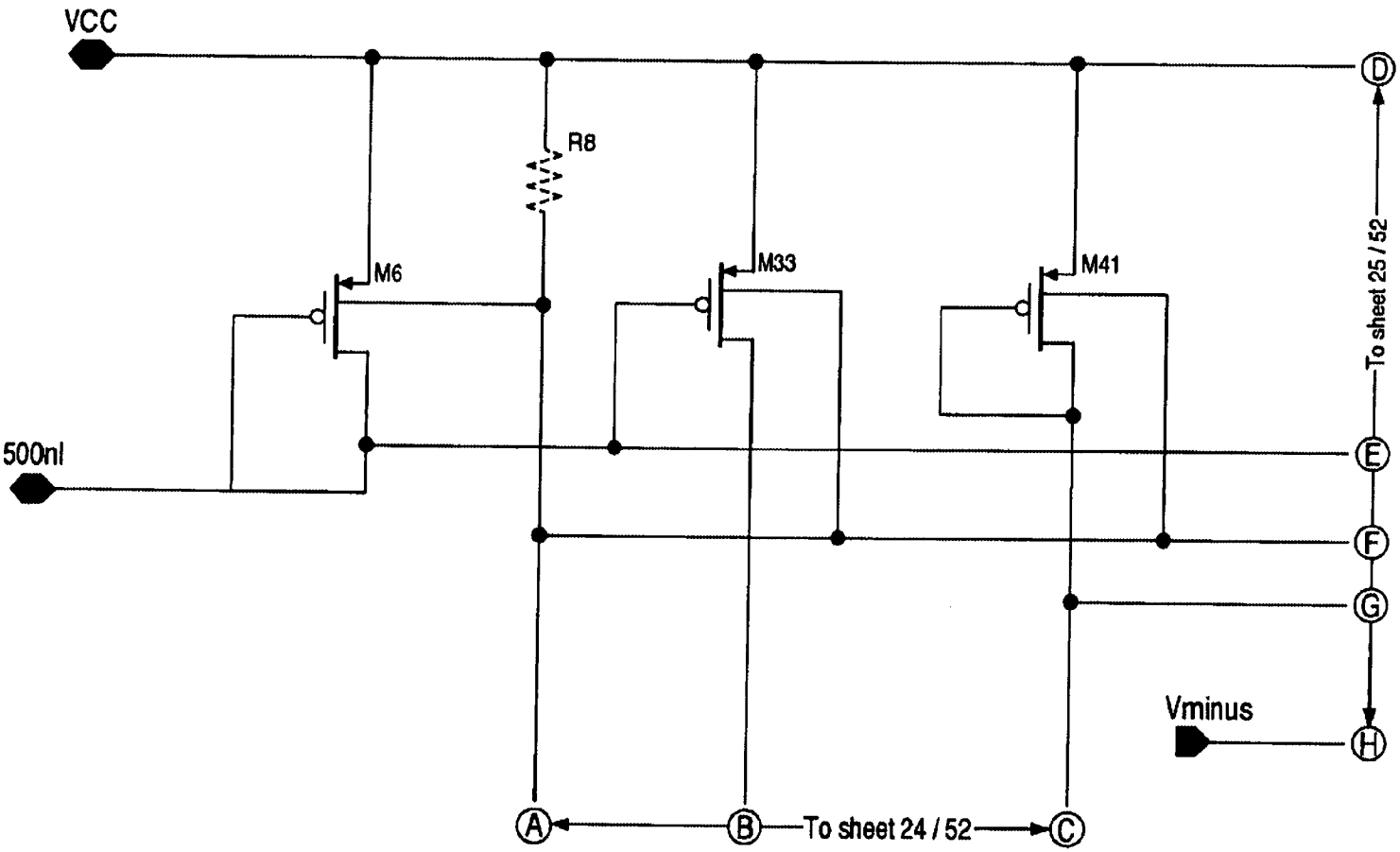
FIG. 8 is a schematic diagram further illustrating another embodiment of an input stage for the operational amplifier of FIG. 5 that may be implemented as part of the present invention.
Figure 8:
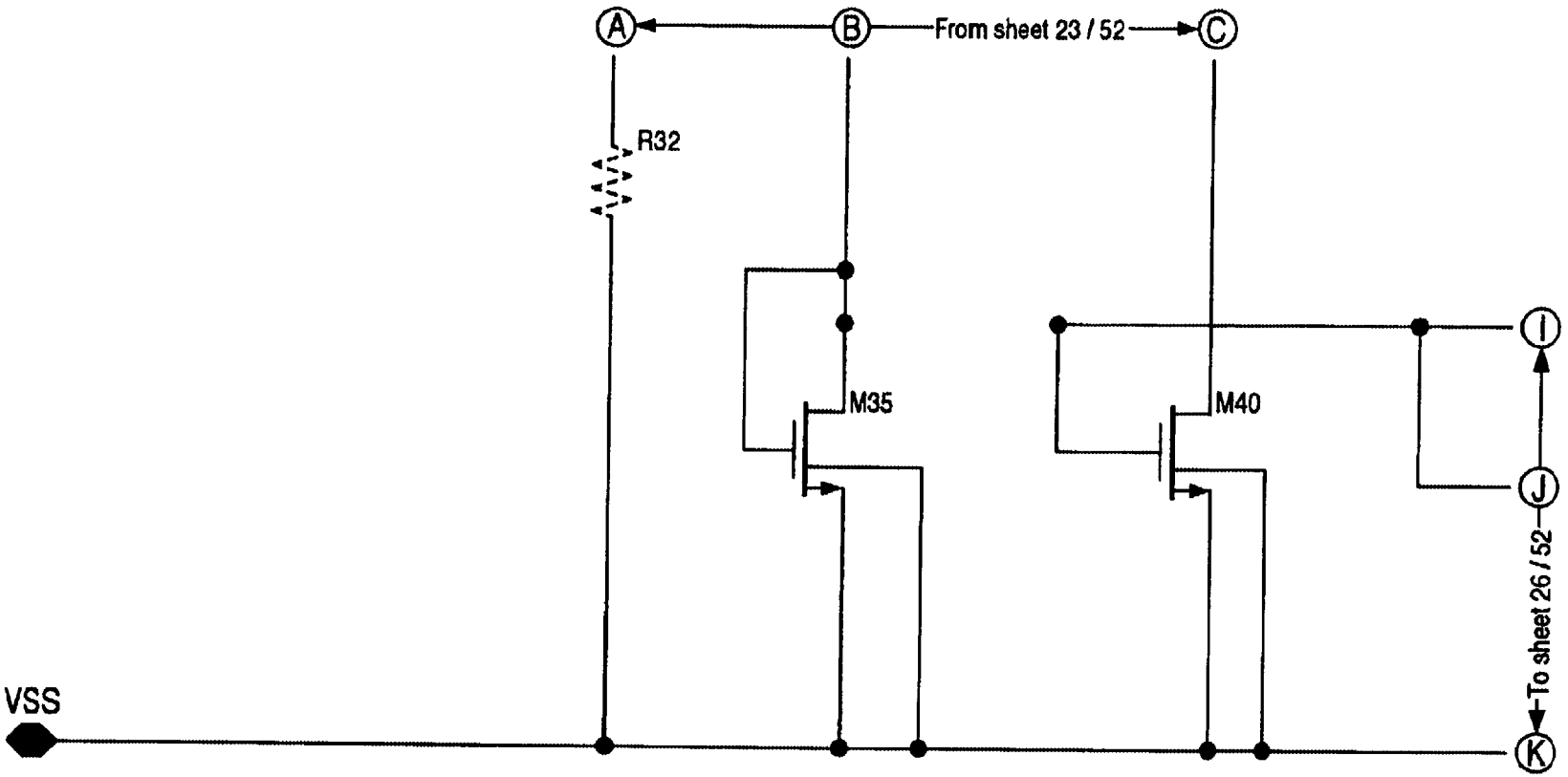
Figure 8:
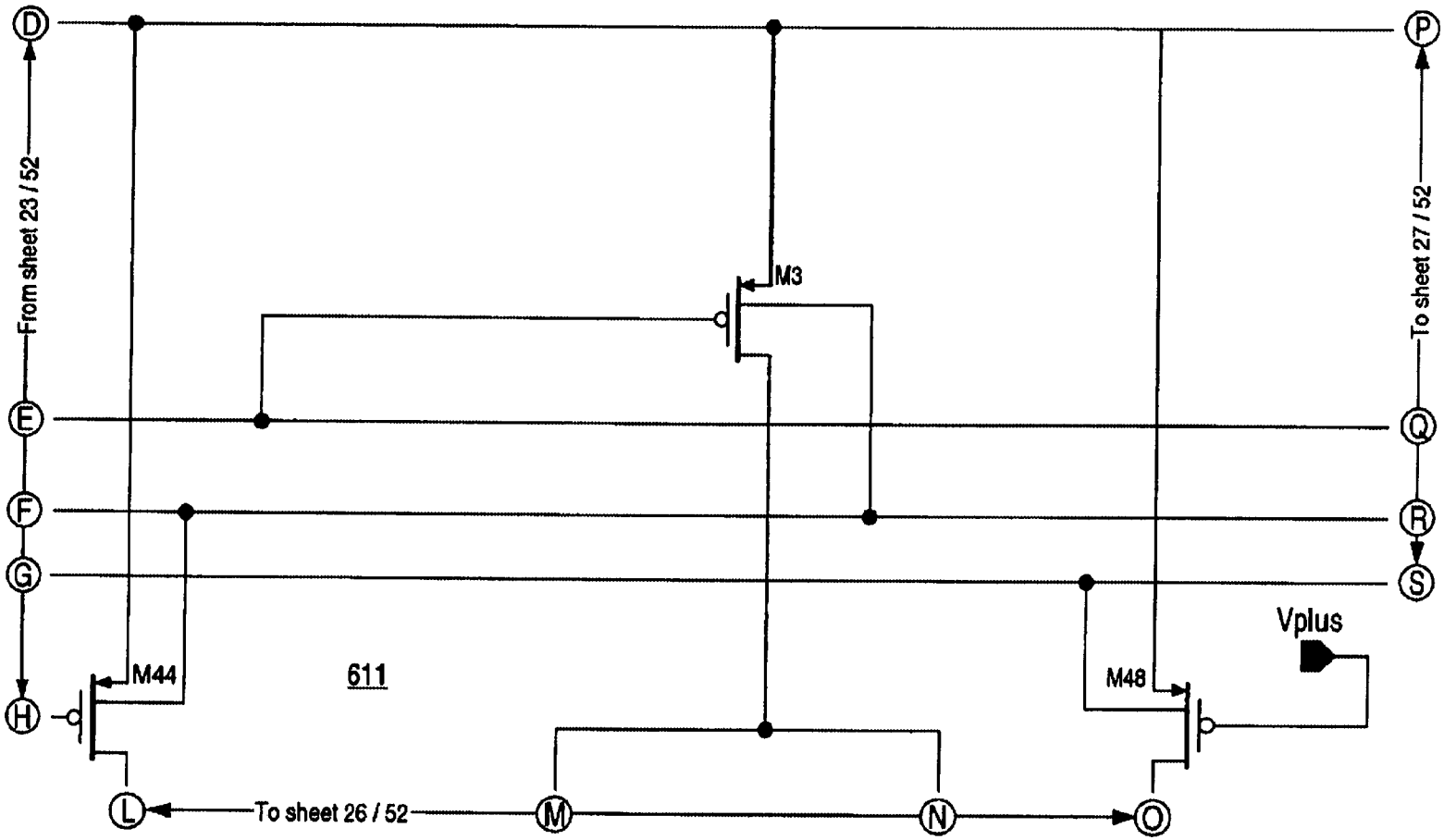
Figure 8:
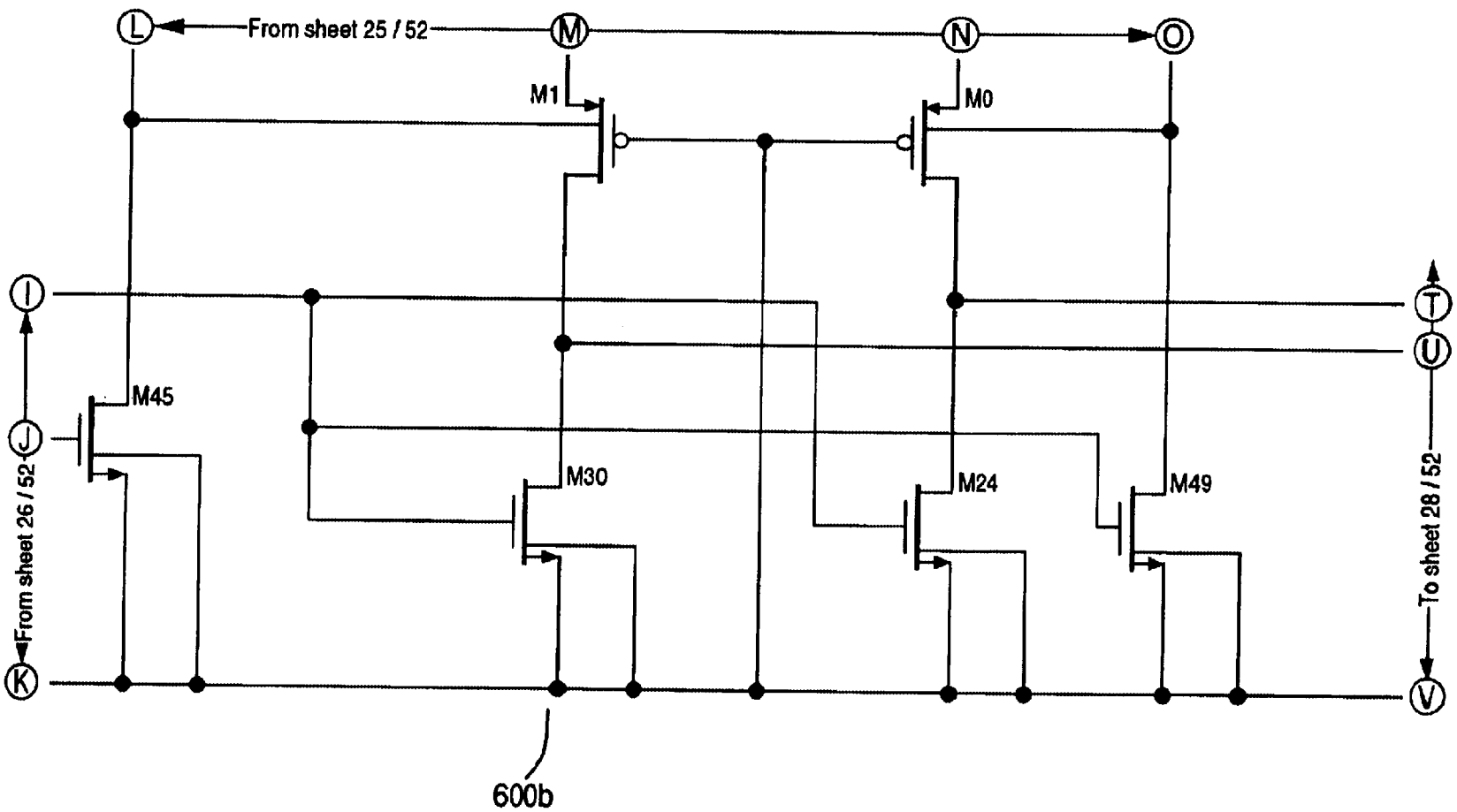
Figure 8:
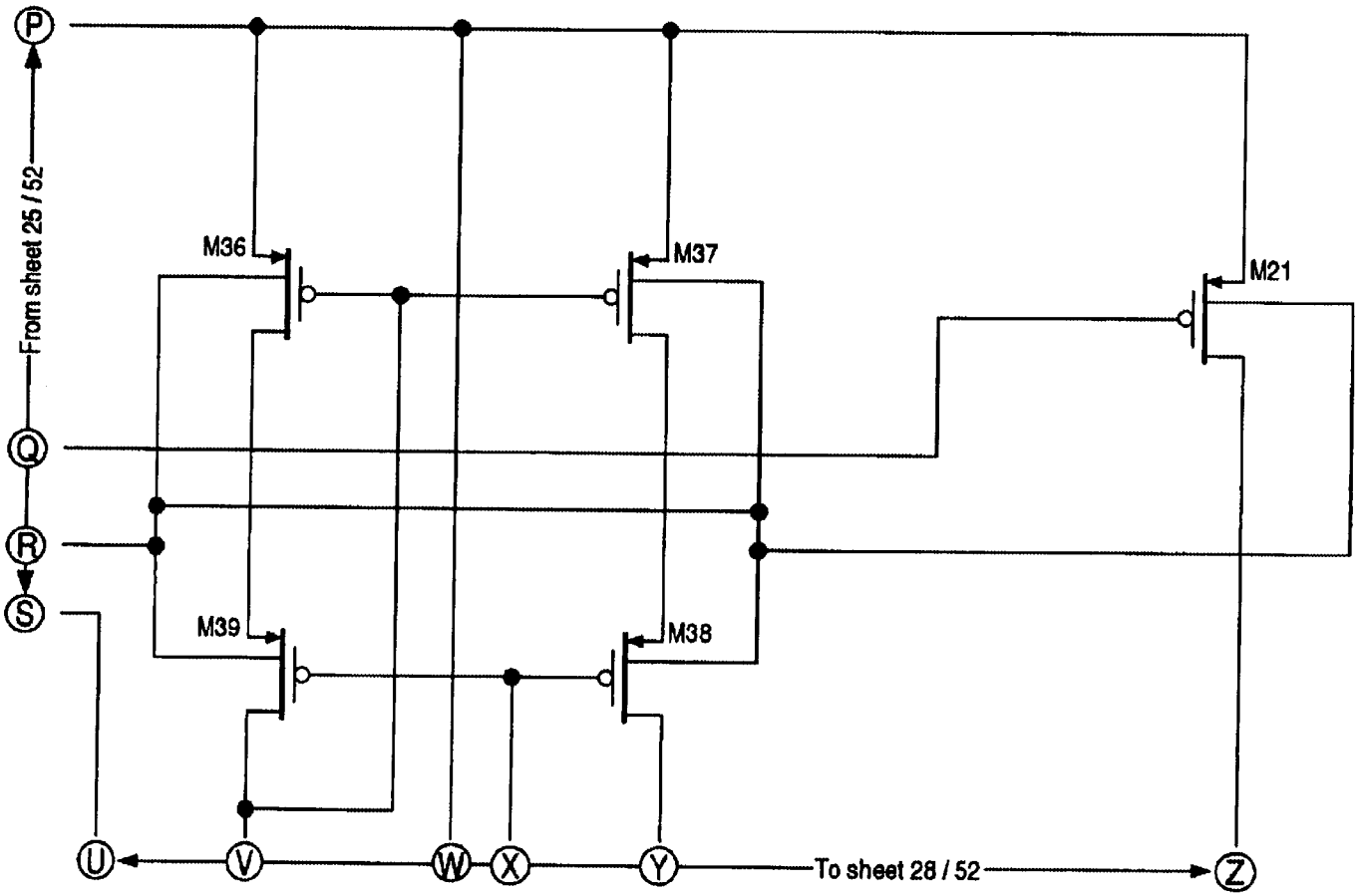
Figure 8:
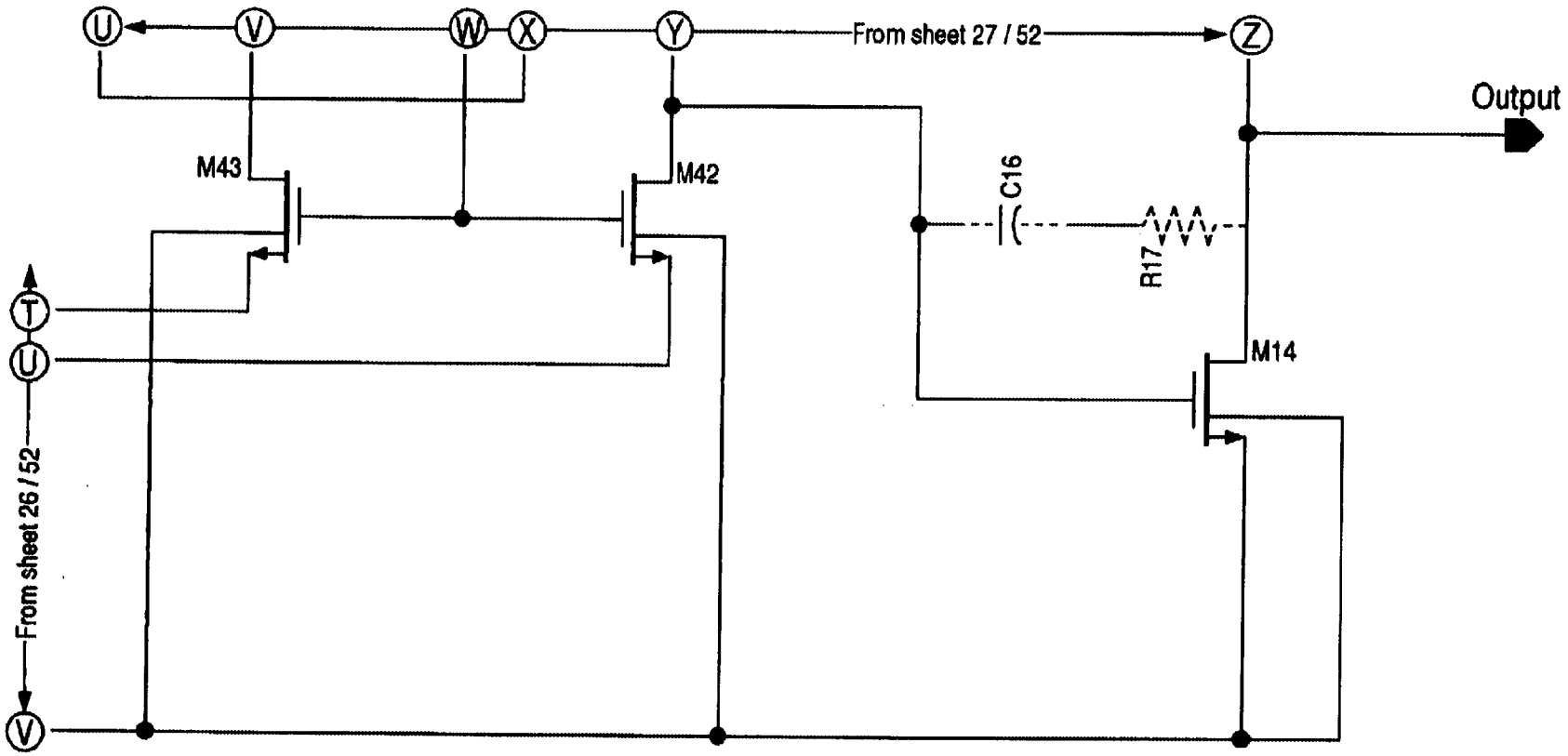

FIG. 7 is a schematic diagram further illustrating one embodiment of an input stage 600*a* for the operational amplifier of FIG. 5 that may be implemented as part of the present invention. FIG. 8 is a schematic diagram further illustrating another embodiment of an input stage 600*b* for the operational amplifier of FIG. 5 that may be implemented as part of the present invention. Input stage 600*a* is based on a direct junction input 610 while input stage 600*b* includes a P-channel level shifter/current buffer 611.

FIG. 9 is a schematic diagram of one embodiment of an operational amplifier 105*b* that may be implemented as part of the present invention. In the present embodiment, full rail-to-rail operation is achieved with a supply voltage of less than one volt. In this embodiment, op-amp 105*b* includes an oscillator 901, a phase generator 902, a one-volt doubler 903, and an input stage 904. Op-amp 105*b* as illustrated in FIG. 9 is used by circuit 100 to realize an accurate sub-bandgap voltage in accordance with the present invention. Operational amplifier 105*b* realizes sub-one volt operation by making use of back gating (Gmb) as the input stage, allowing full rail-to-rail input and output swings.

Figure 10:
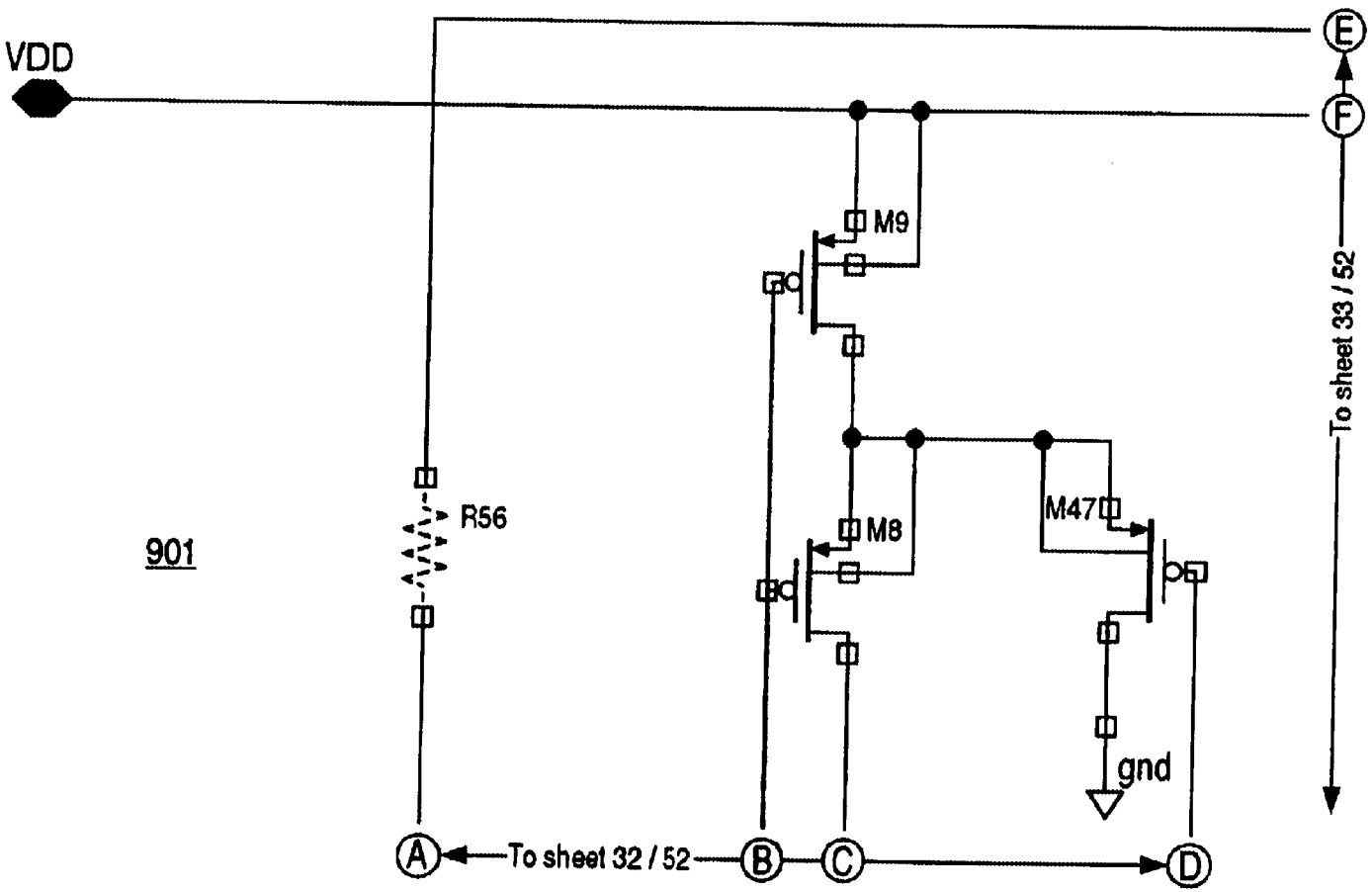
FIG. 10 is a schematic diagram of one embodiment of an oscillator that may be implemented as part of the present invention.
Figure 10:
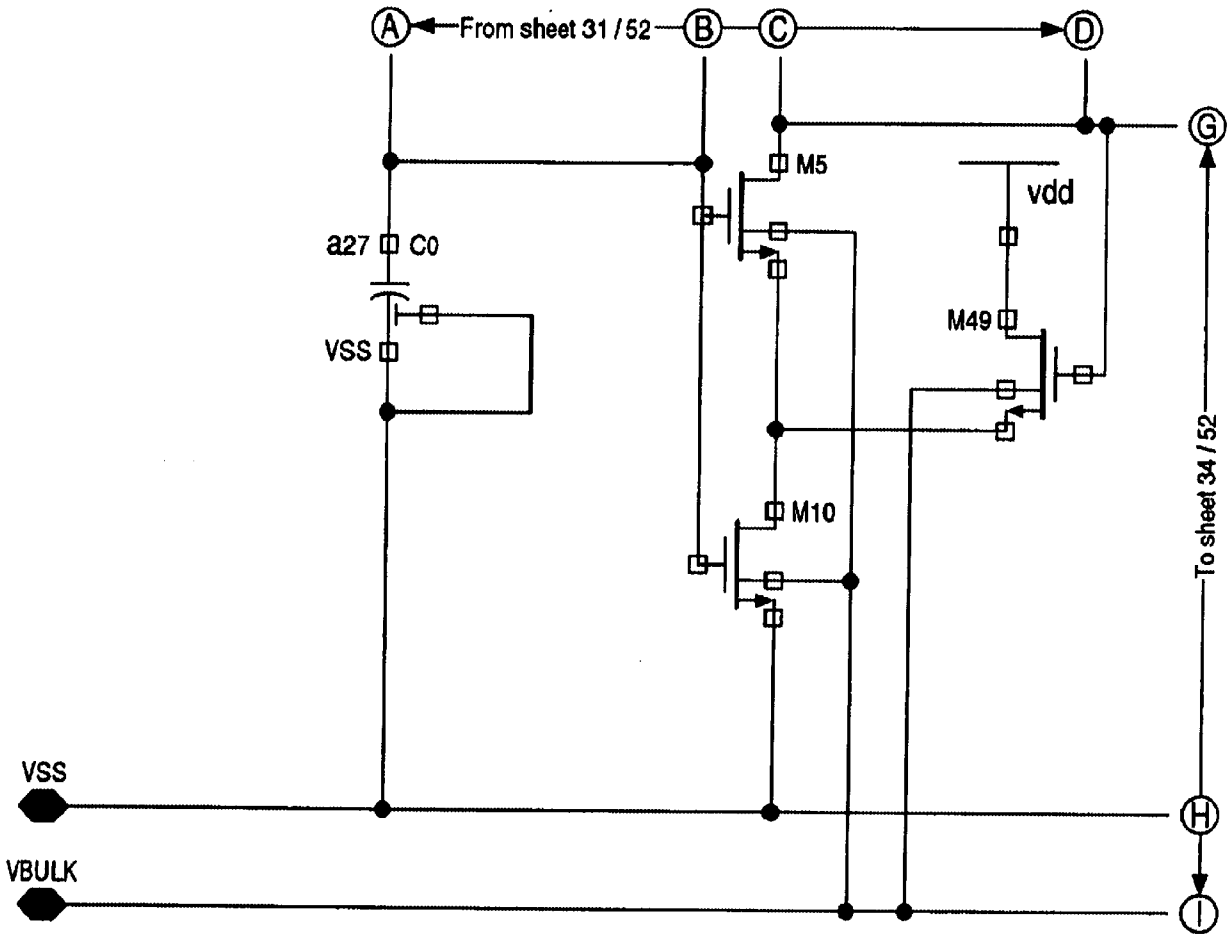
Figure 10:
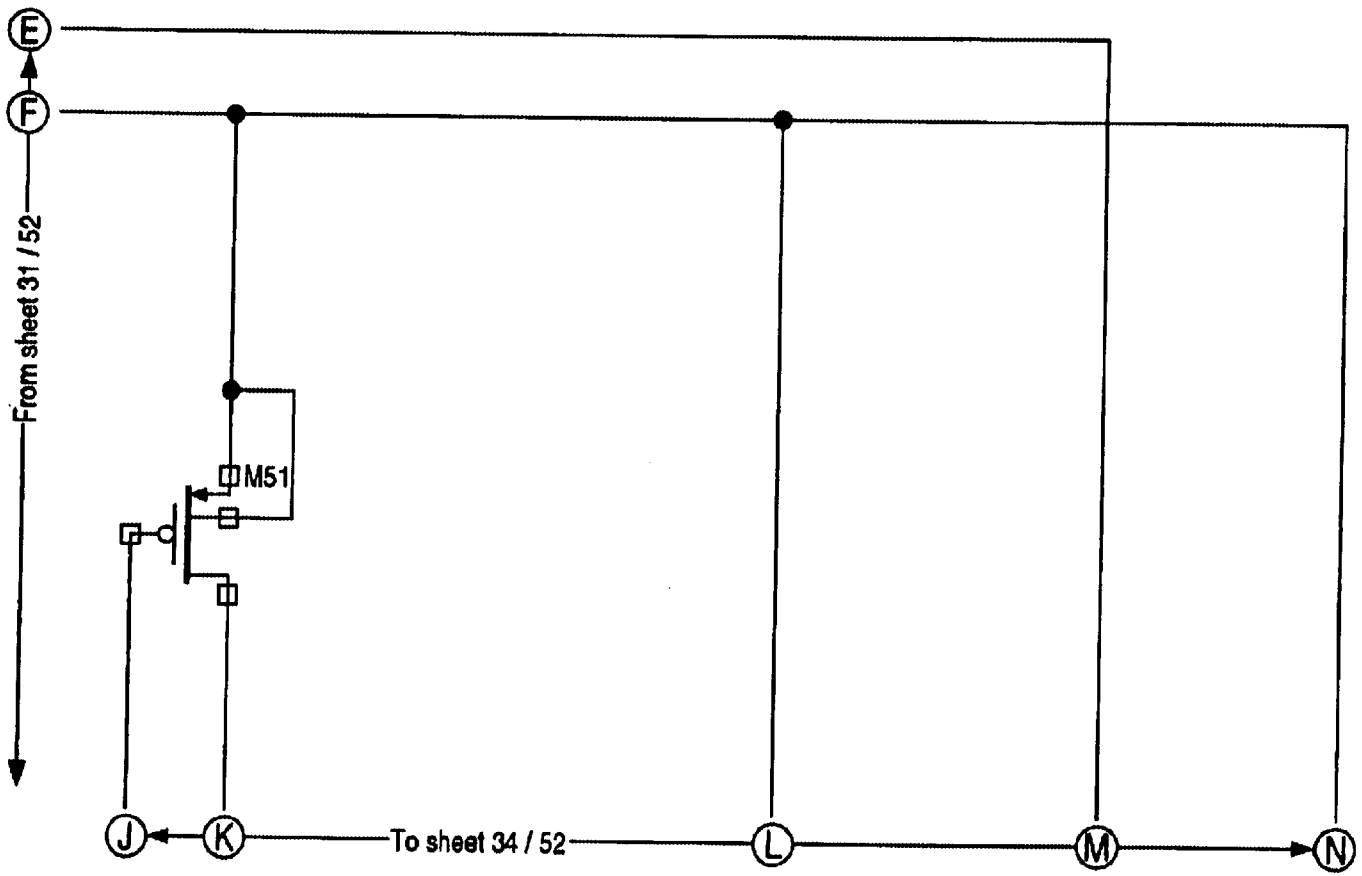
Figure 10:
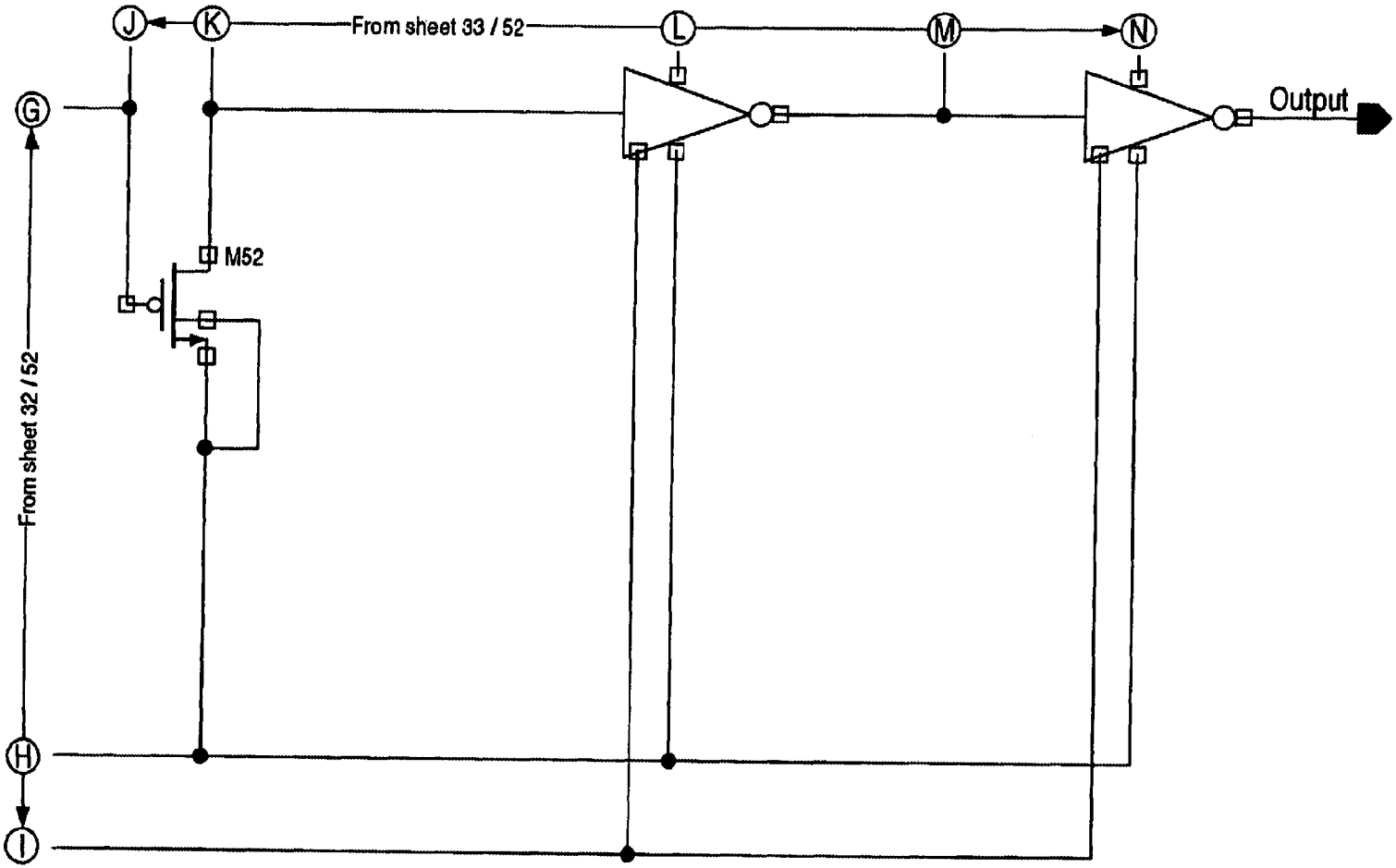
Figure 11:
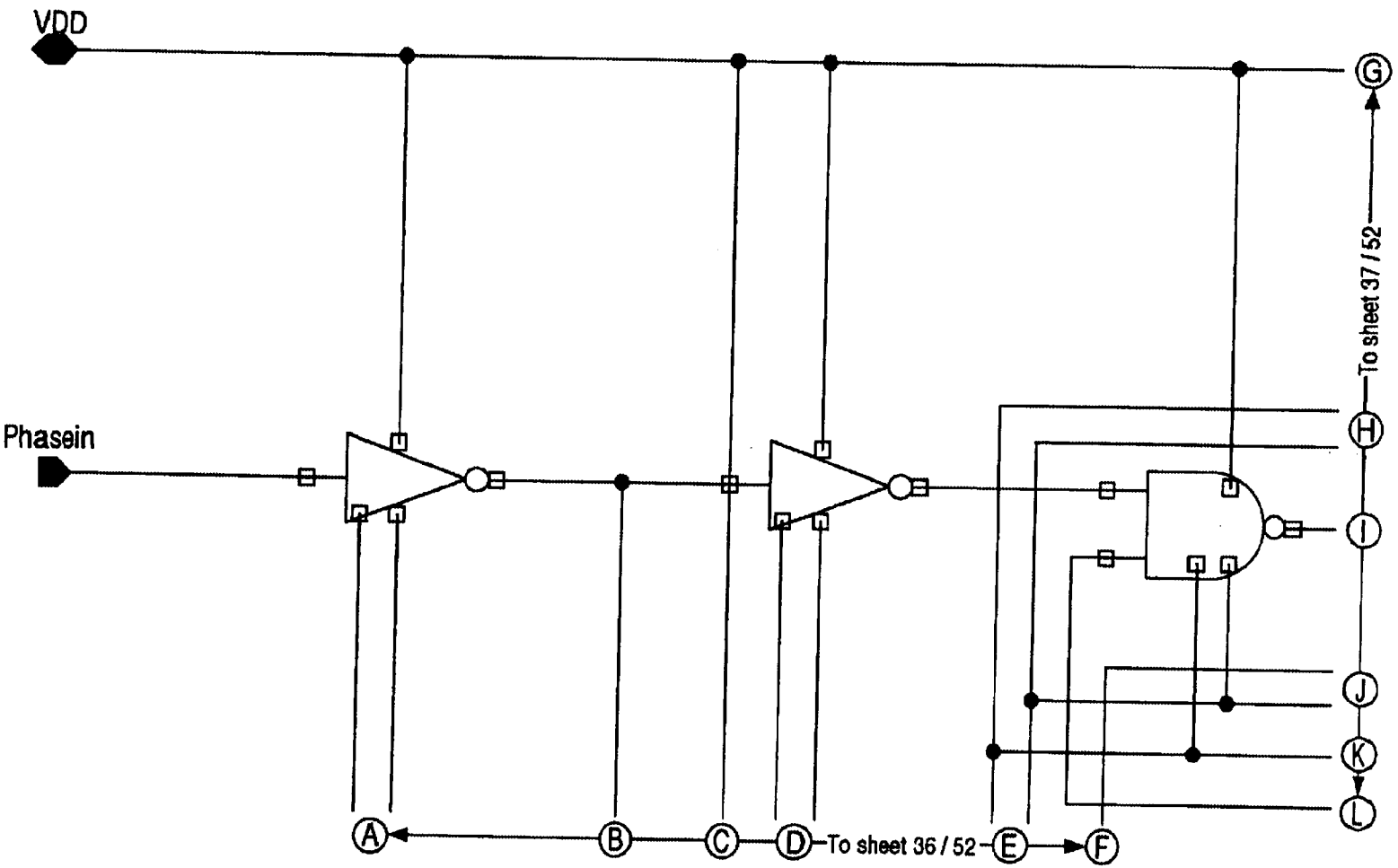
FIG. 11 is a schematic diagram of one embodiment of a phase generator that may be implemented as part of the present invention.
Figure 11:
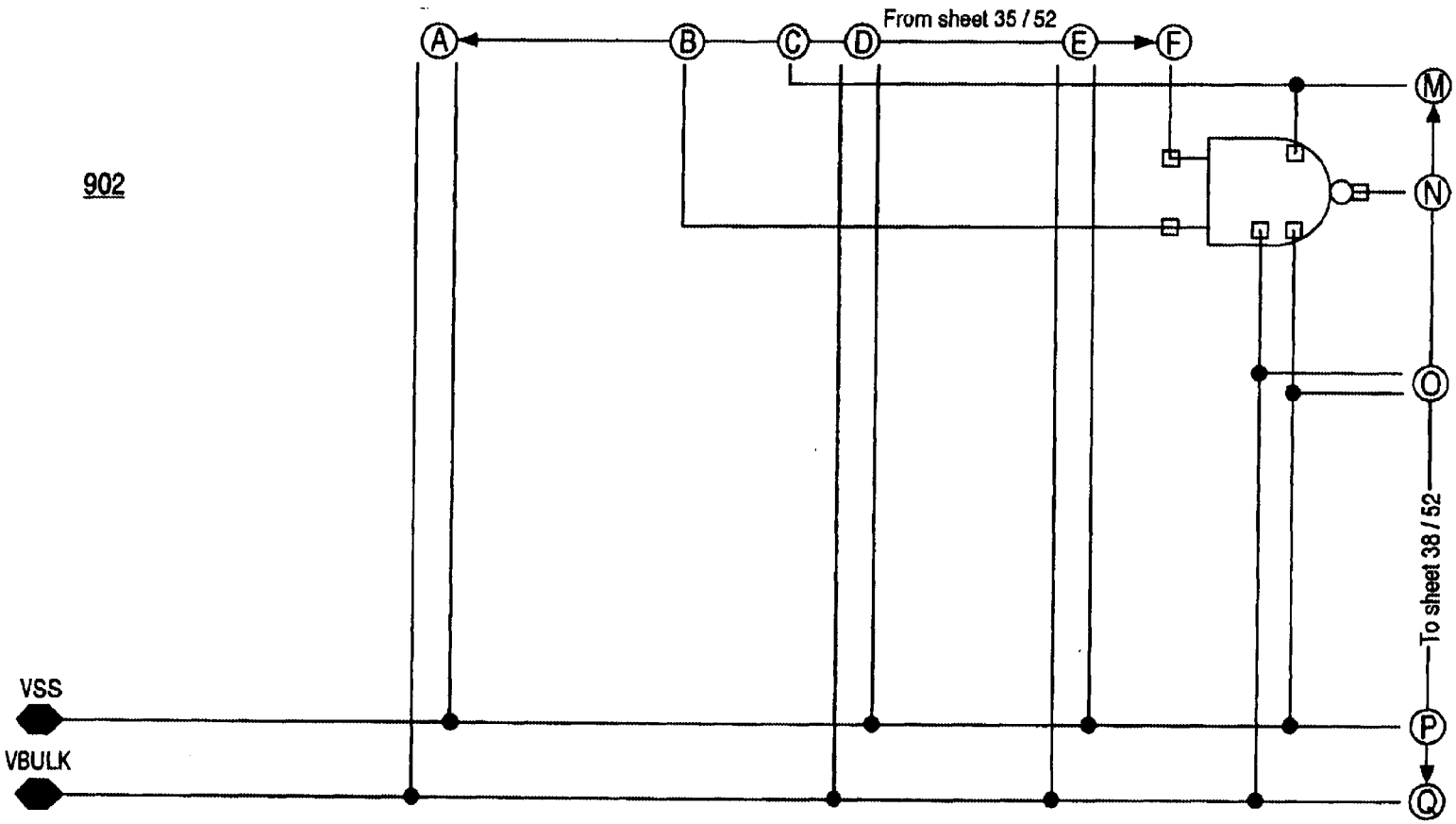
Figure 11:
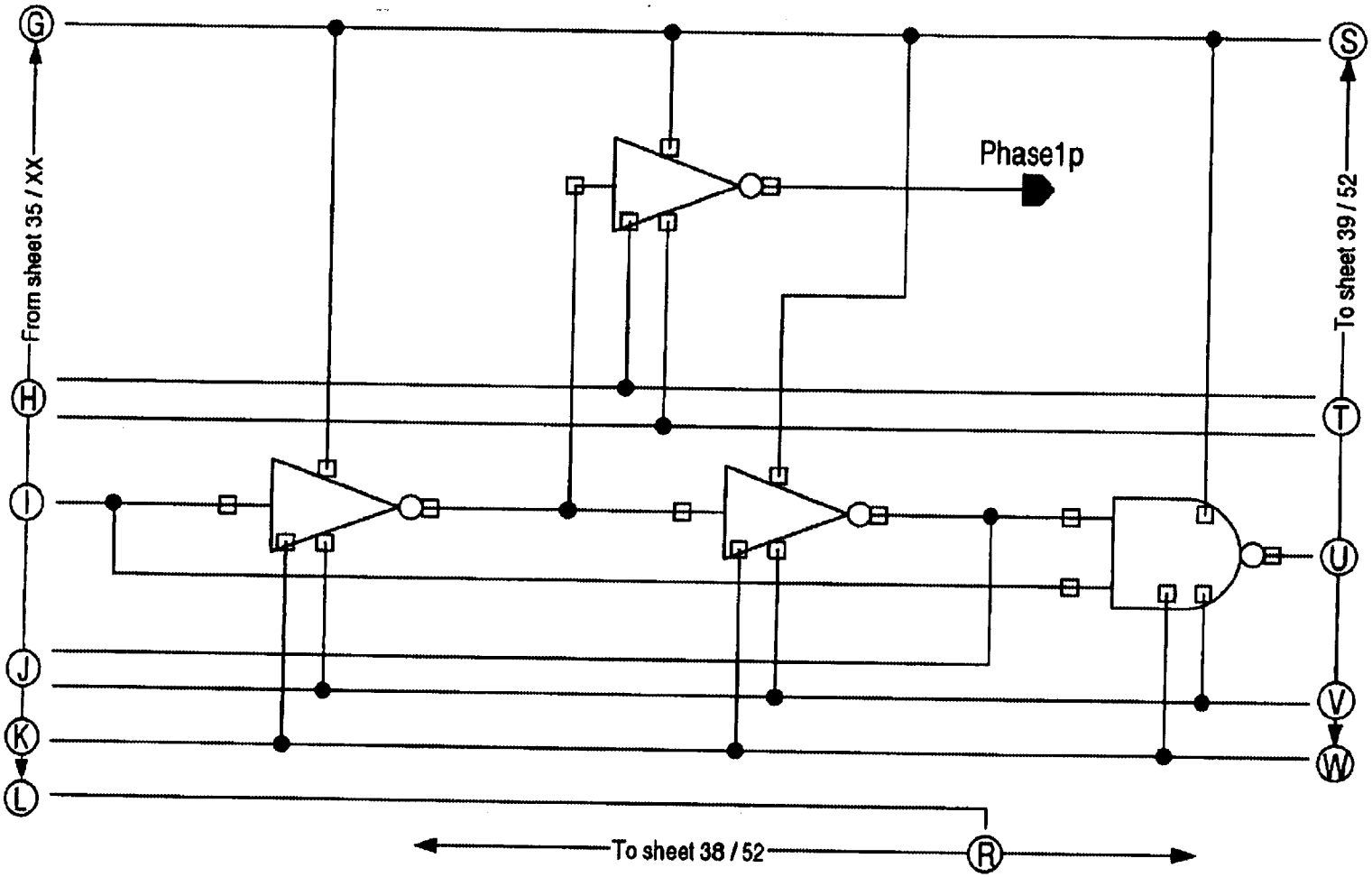
Figure 11:
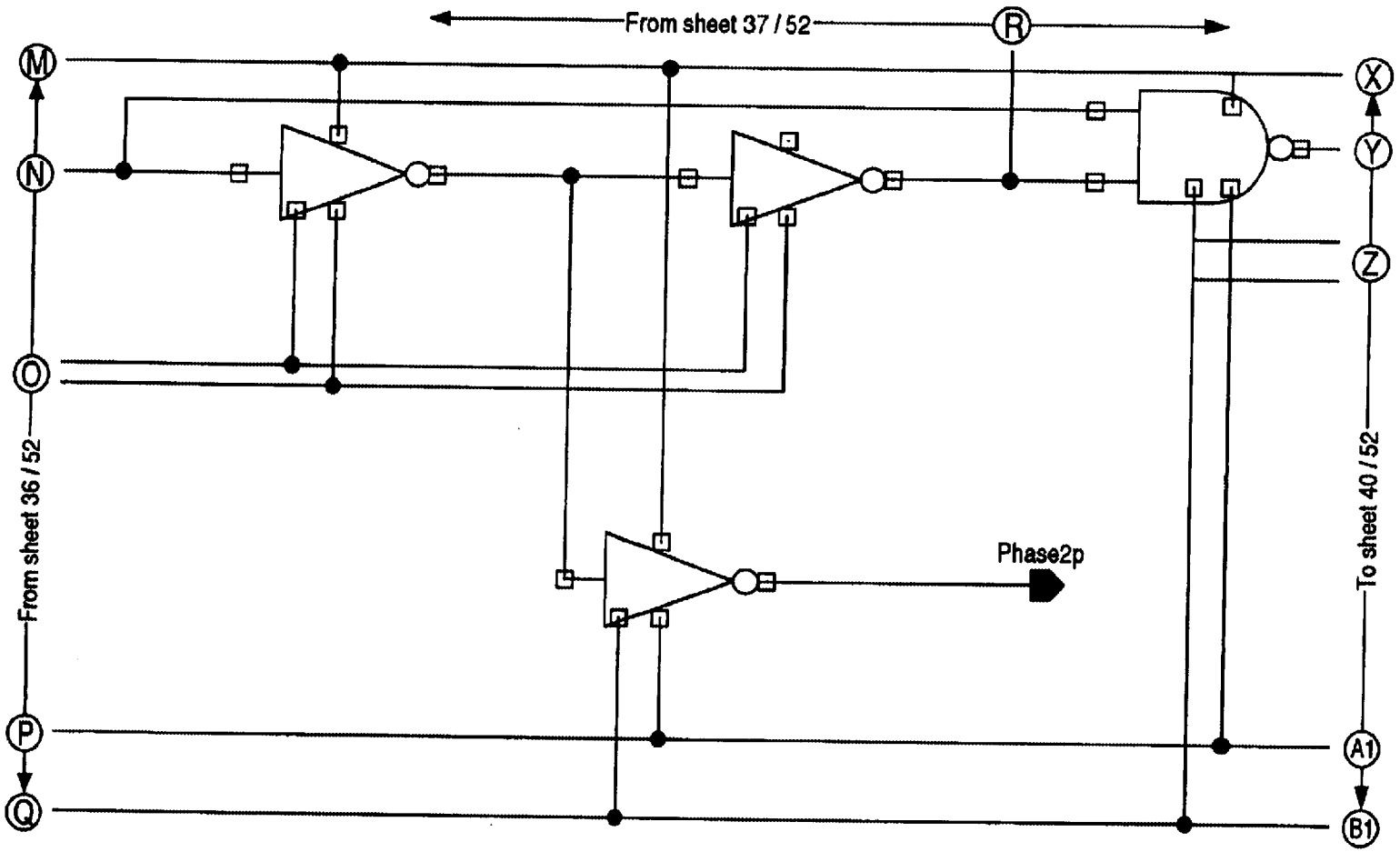
Figure 11:
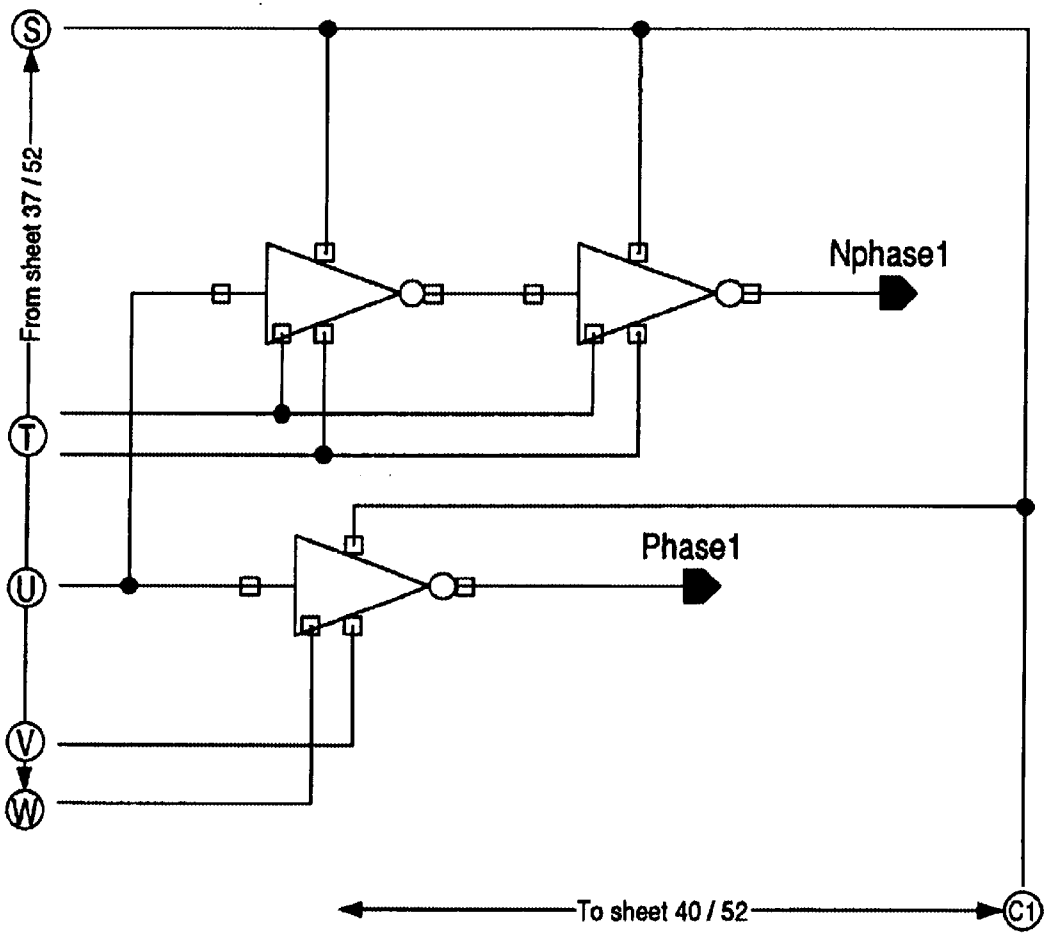
Figure 11:
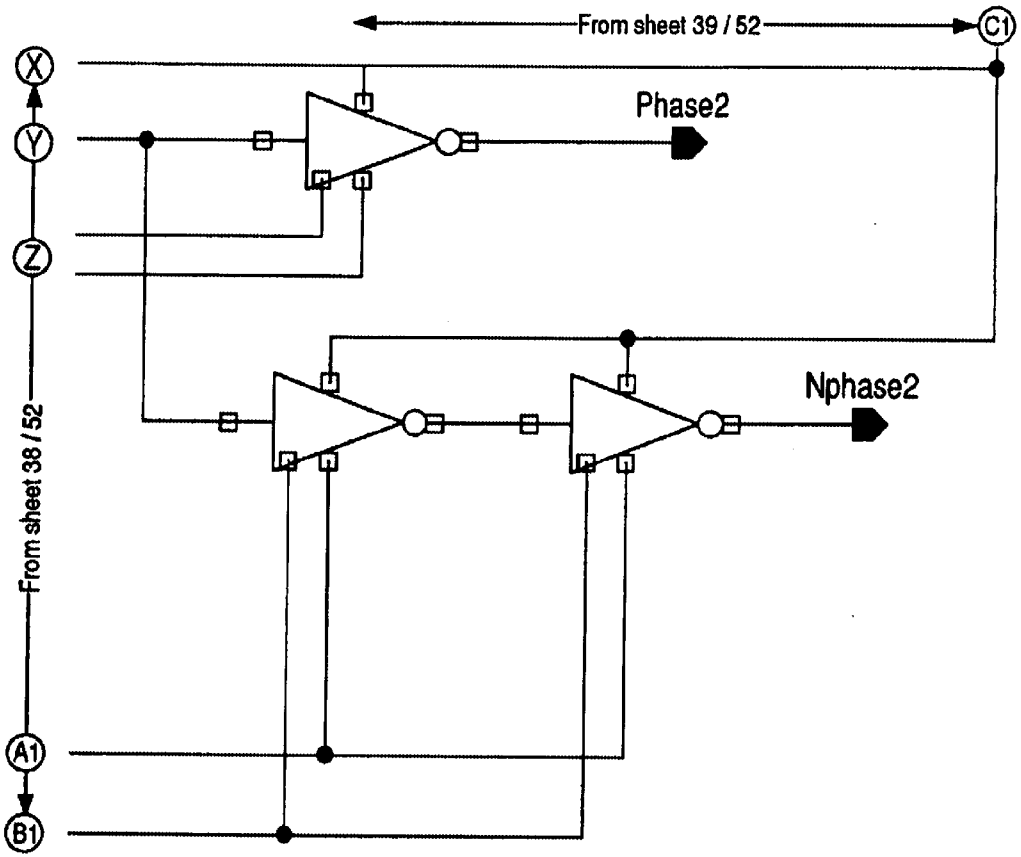
Figure 12:
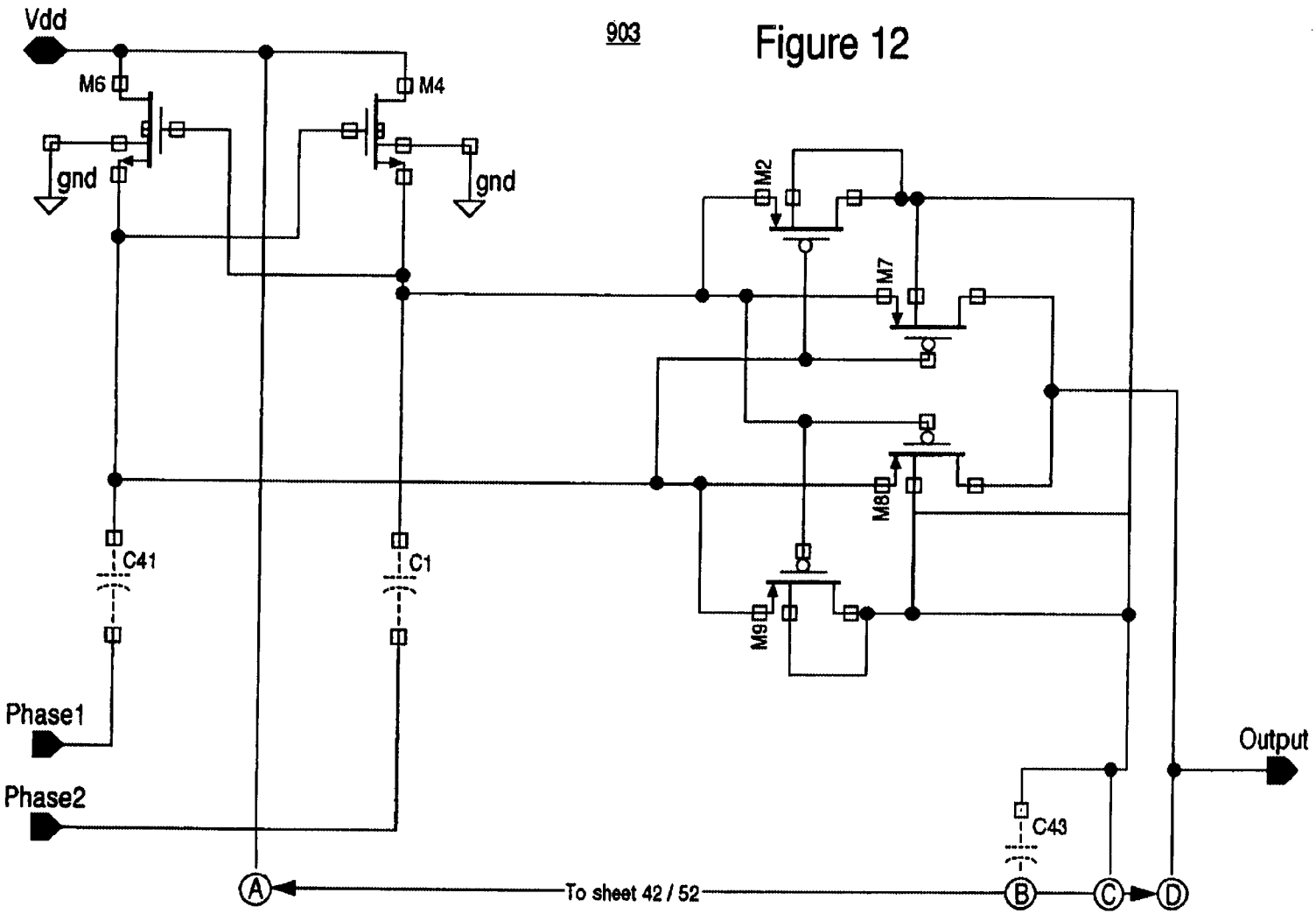
FIG. 12 is a schematic diagram of one embodiment of a voltage doubler that may be implemented as part of the present invention.
Figure 12:
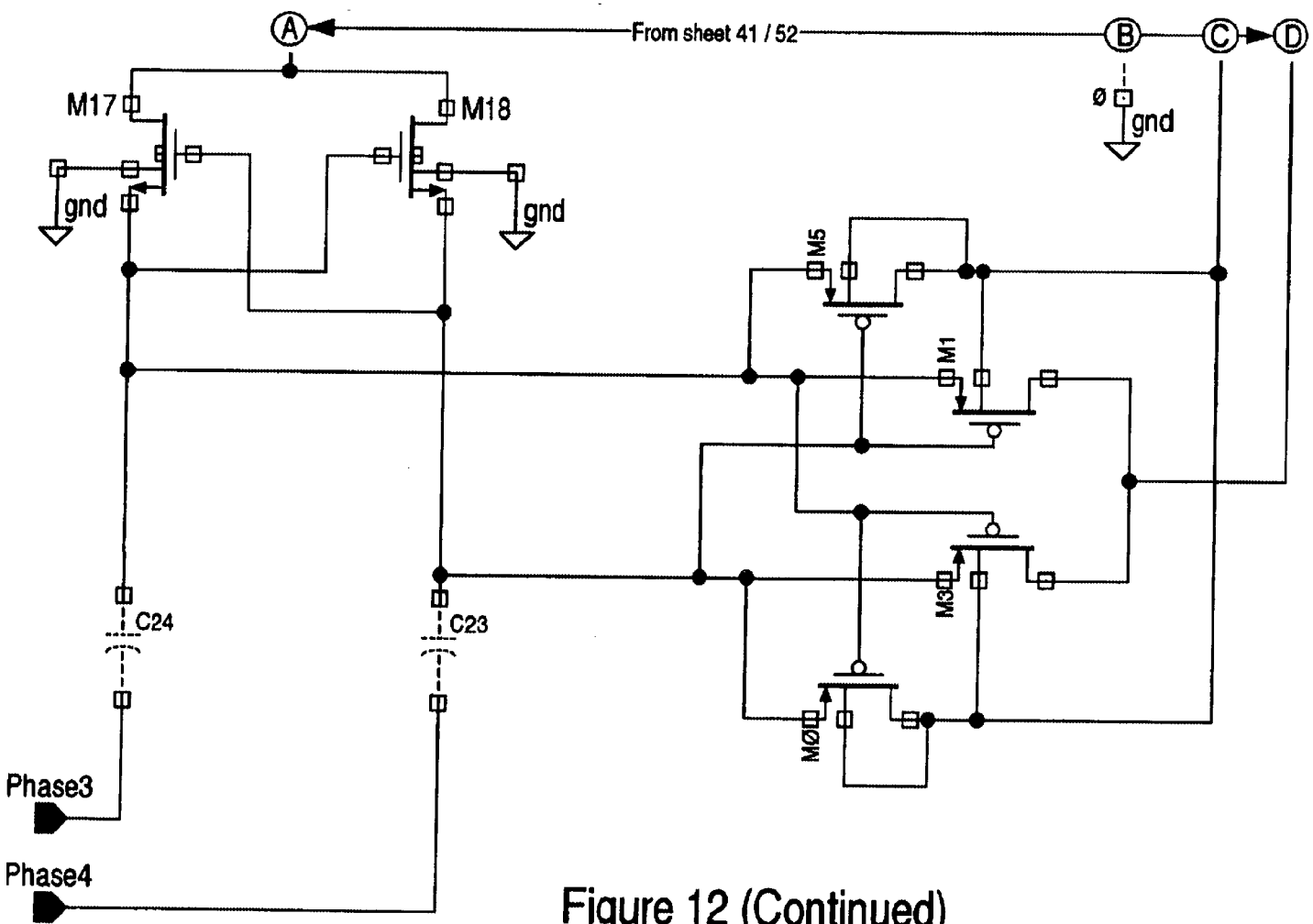

FIG. 10 is a schematic diagram of one embodiment of oscillator 901 that may be implemented as part of the present invention. FIG. 11 is a schematic diagram of one embodiment of phase generator 902 that may be implemented as part of the present invention. FIG. 12 is a schematic diagram of one embodiment of voltage doubler 903 that may be implemented as part of the present invention.

Figure 13:
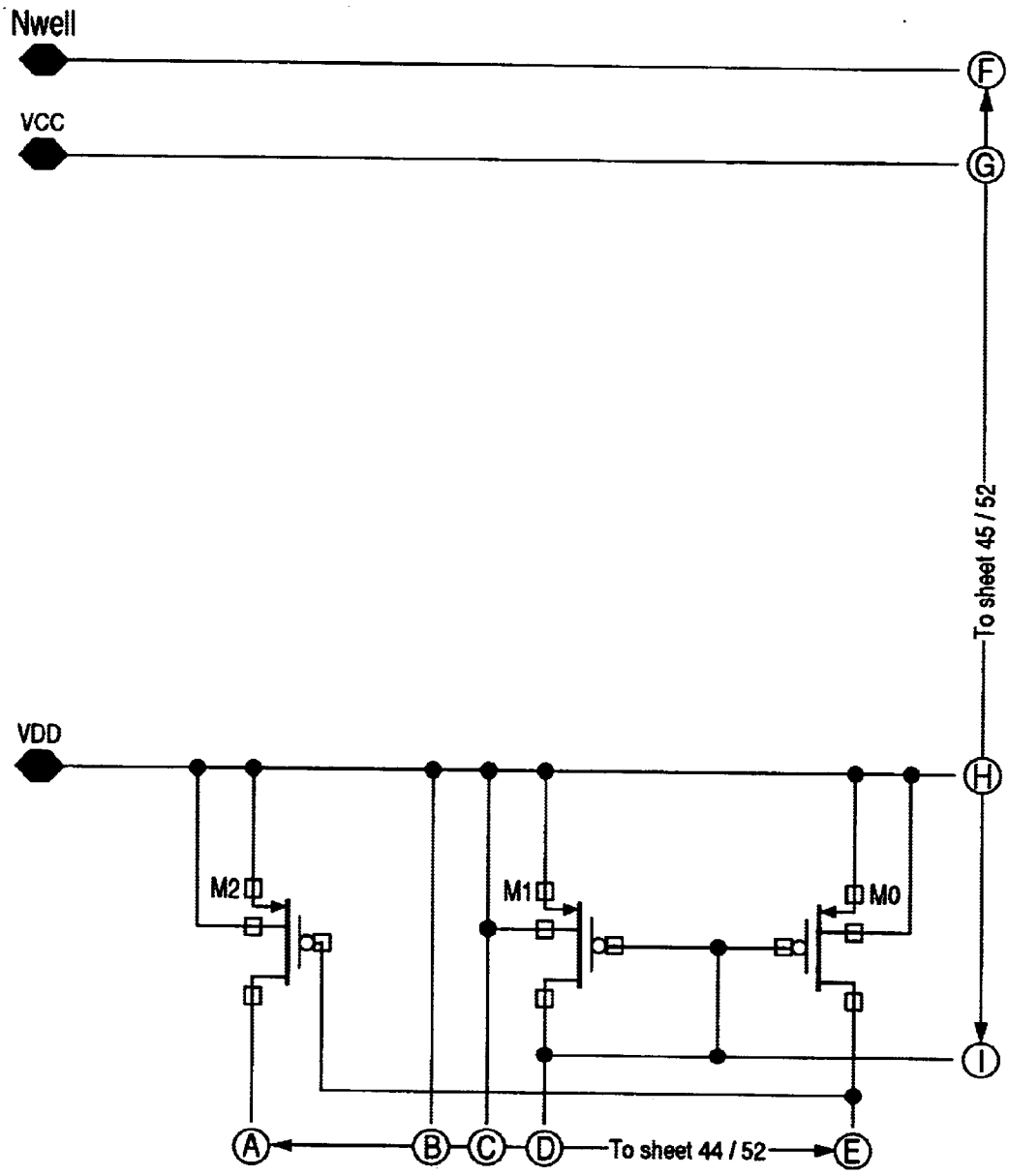
FIG. 13 is a schematic diagram further illustrating one embodiment of an input stage for the operational amplifier of FIG. 9 that may be implemented as part of the present invention.
Figure 13:
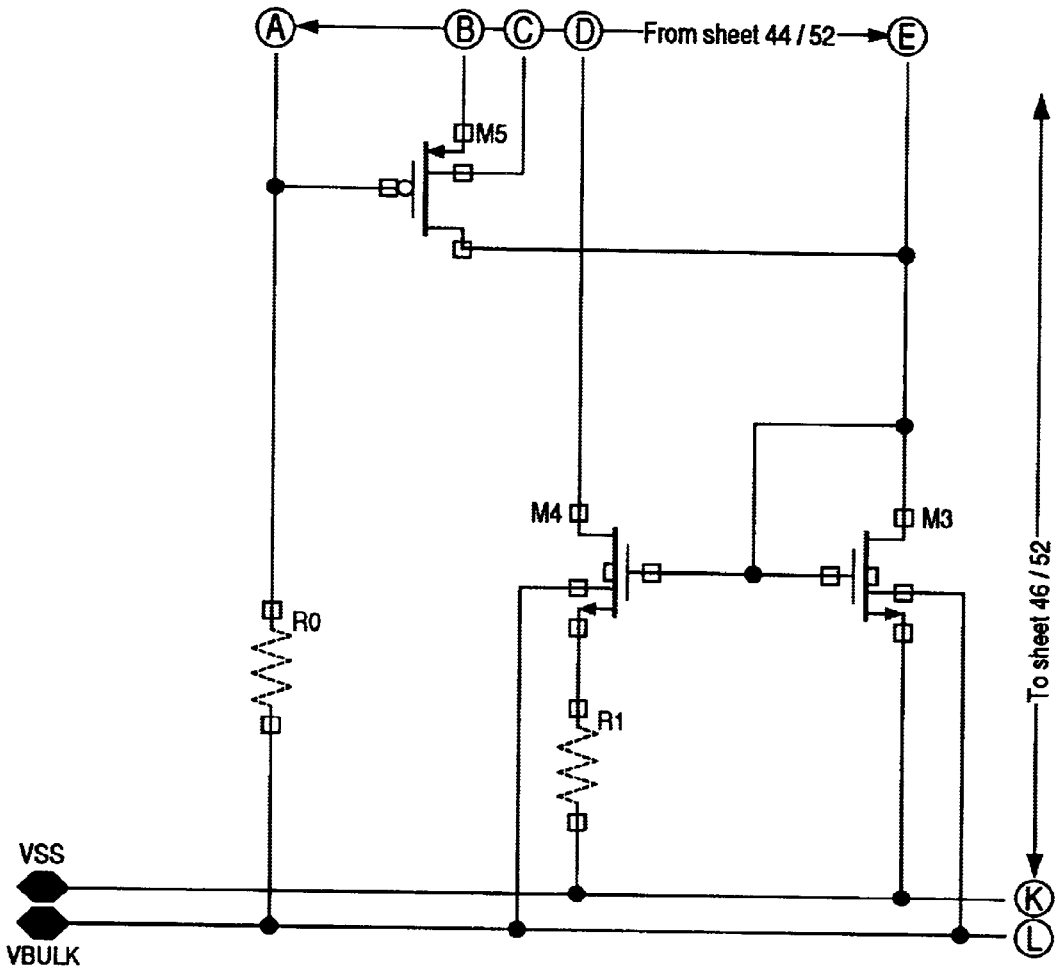
Figure 13:
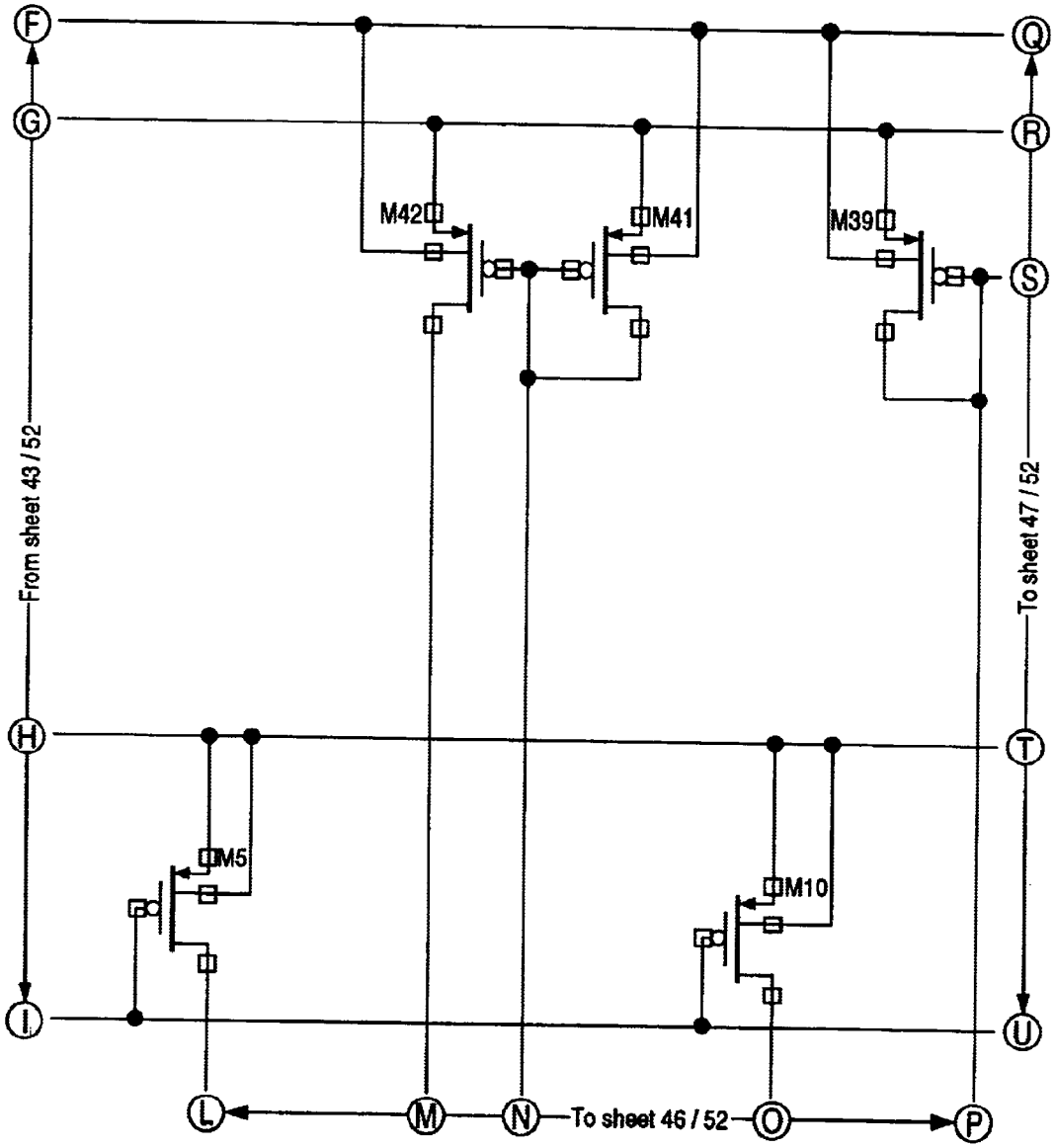
Figure 13:
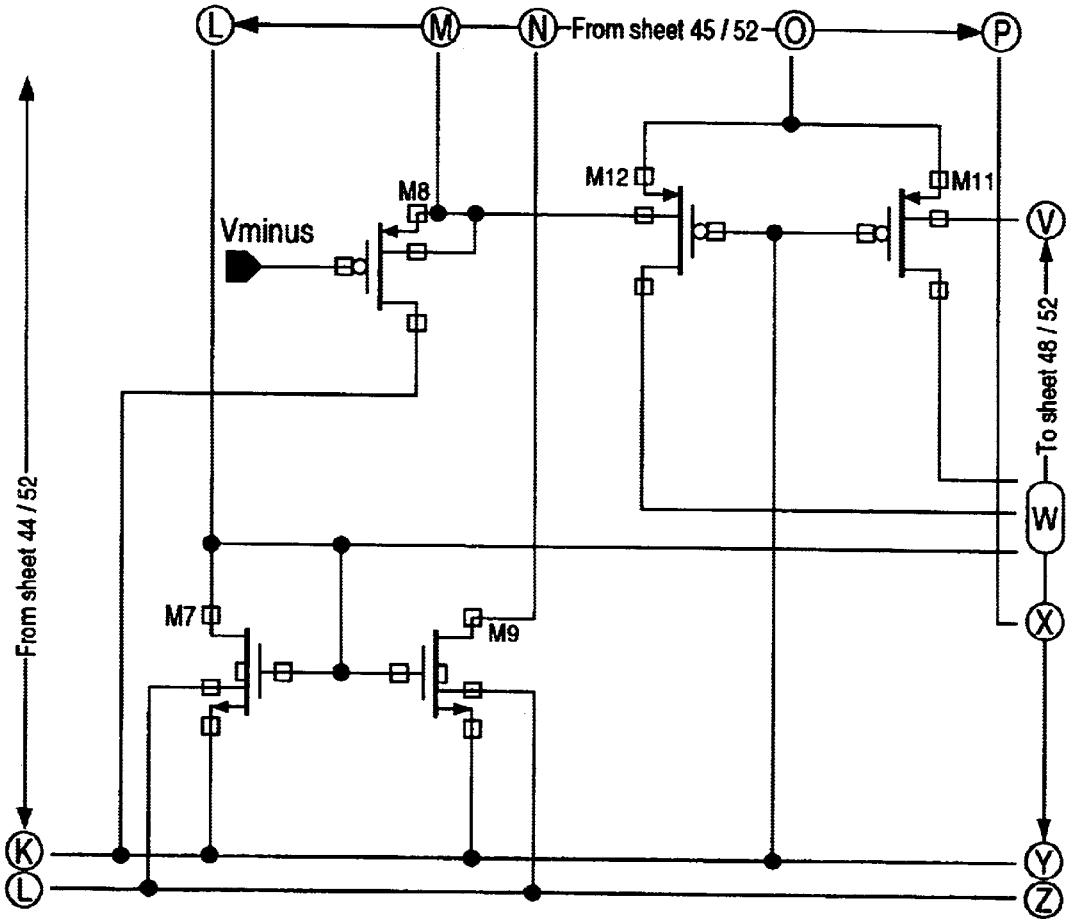
Figure 13:
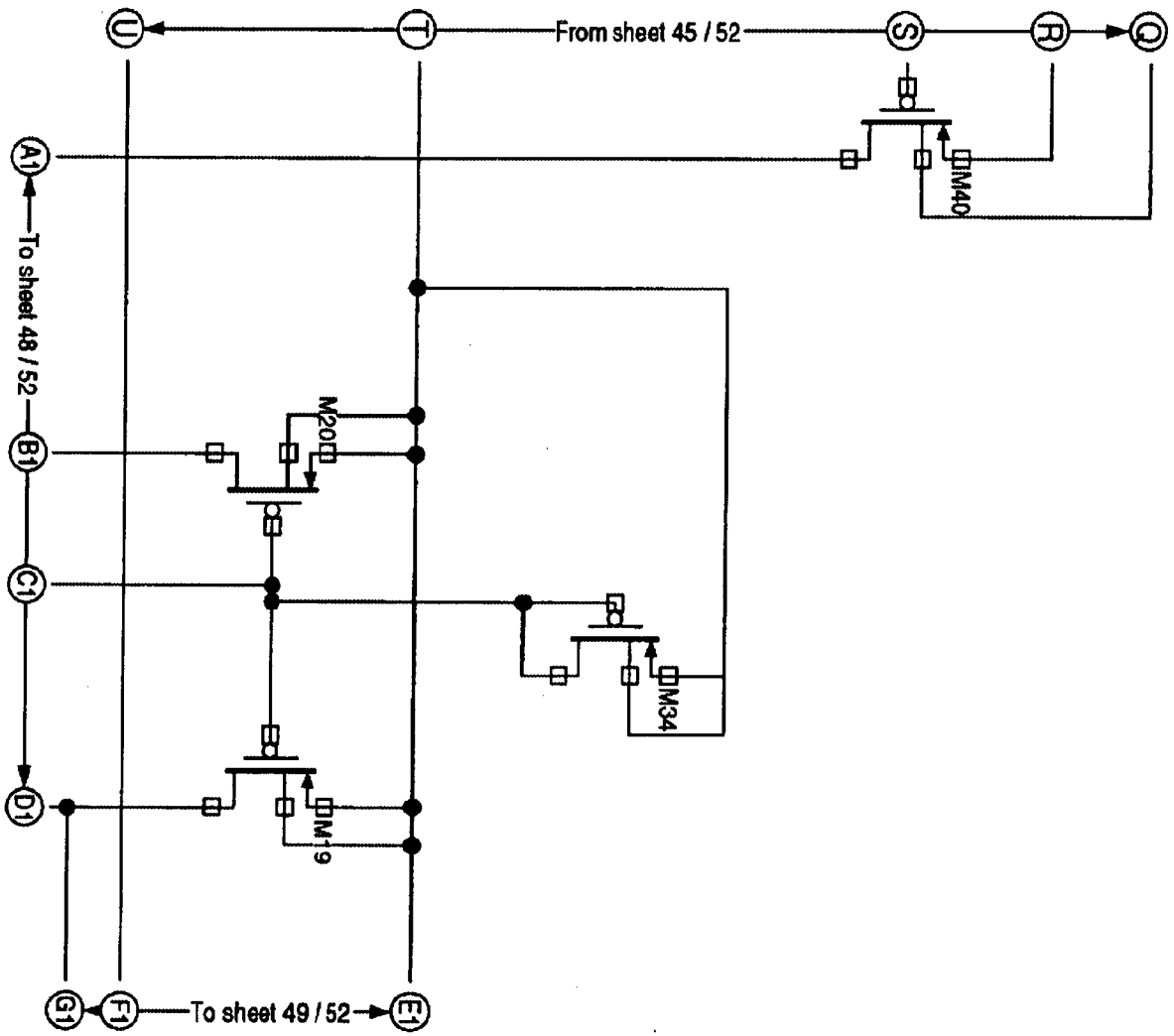
Figure 13:
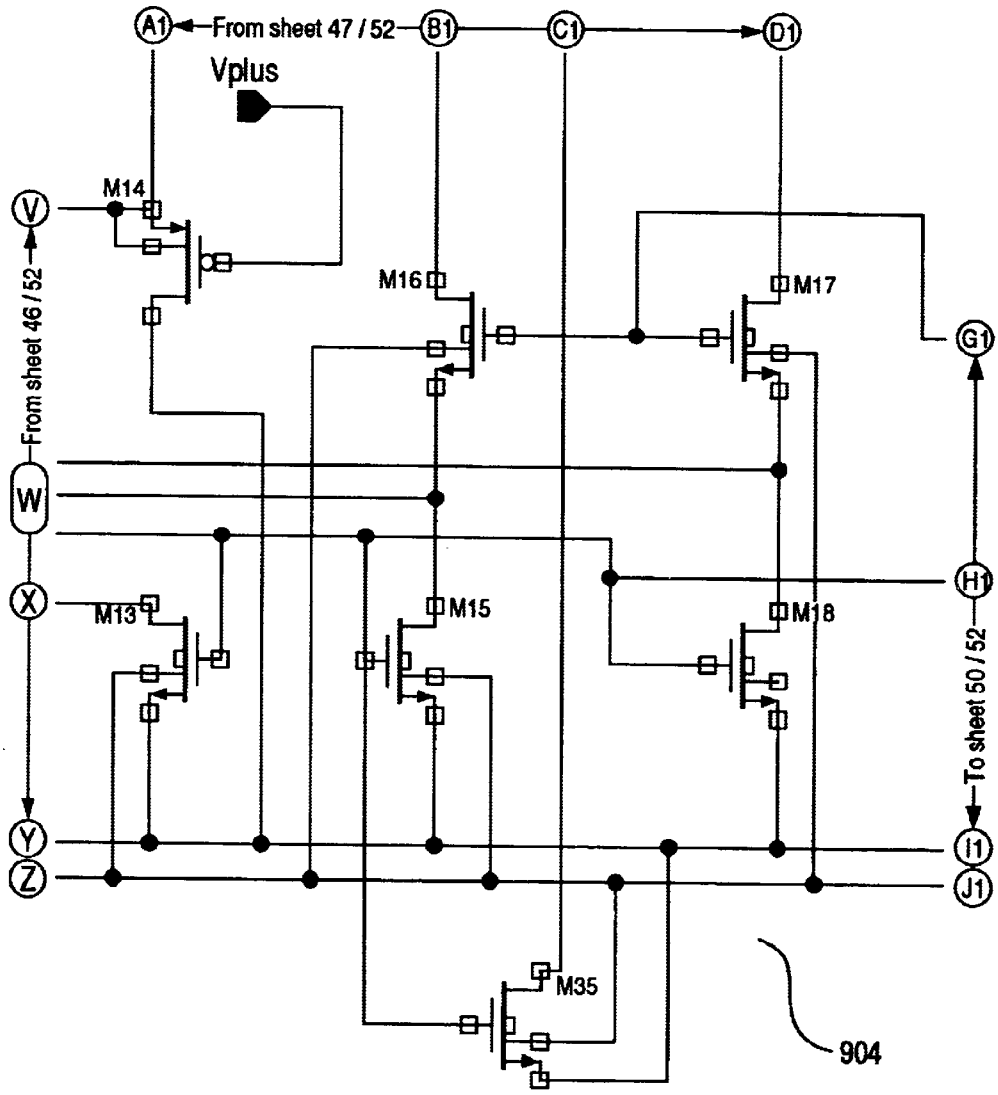
Figure 13:
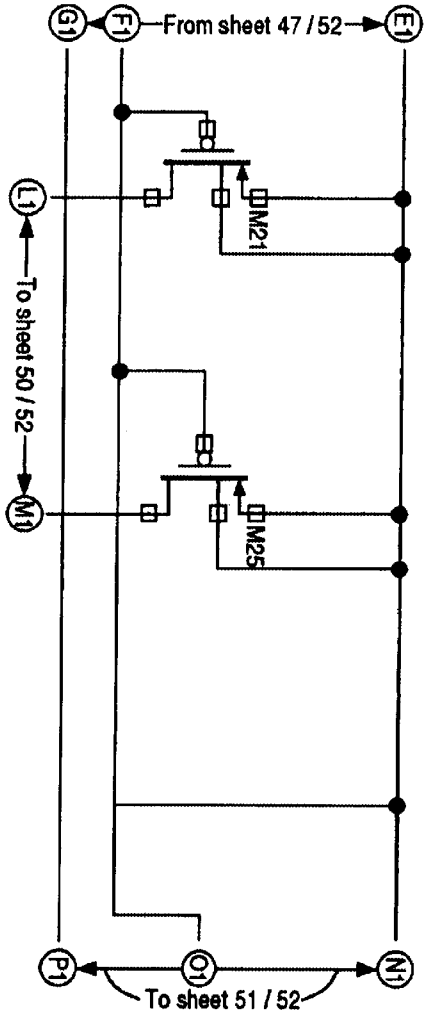
Figure 13:
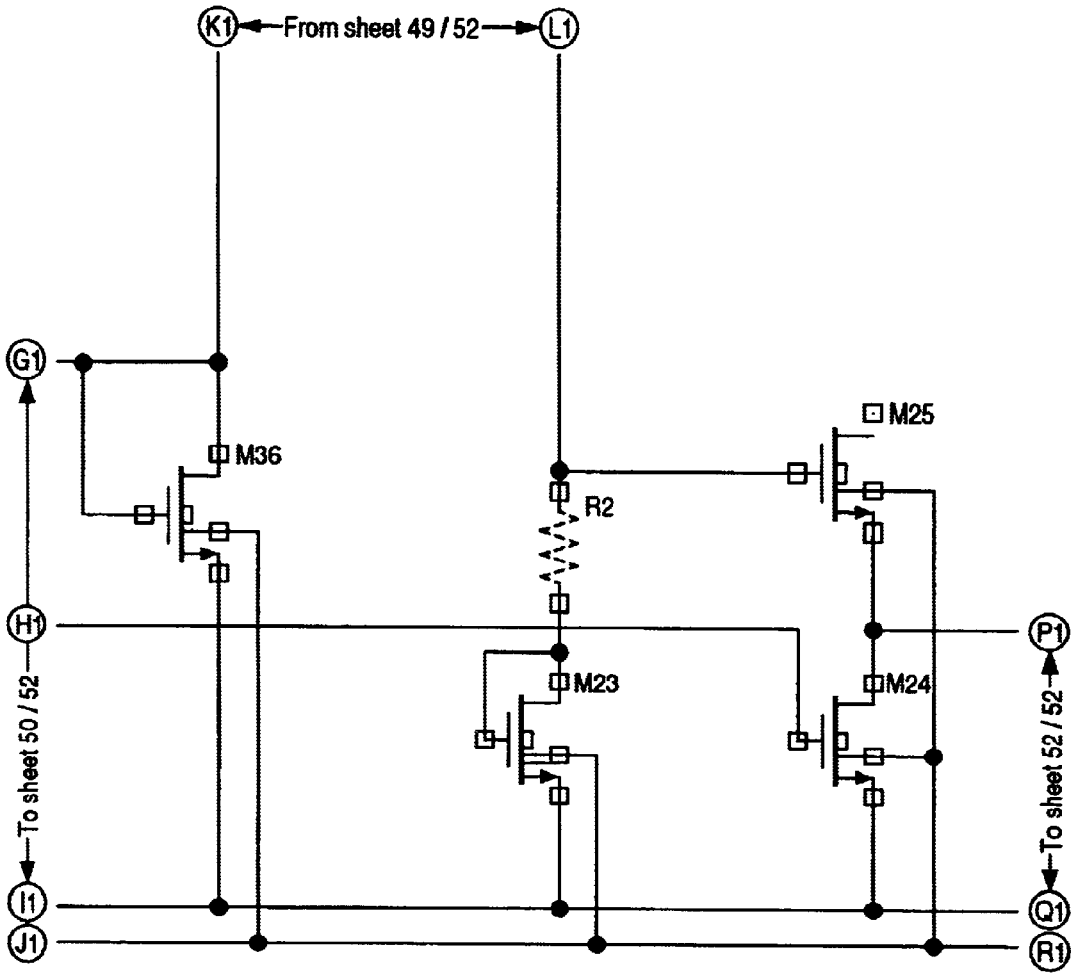
Figure 13:
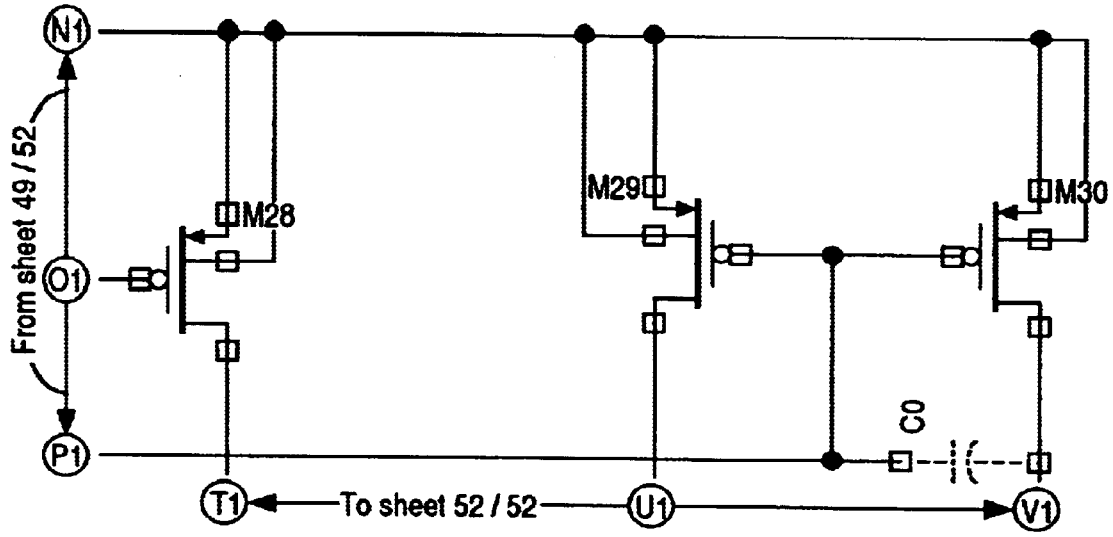
Figure 13:
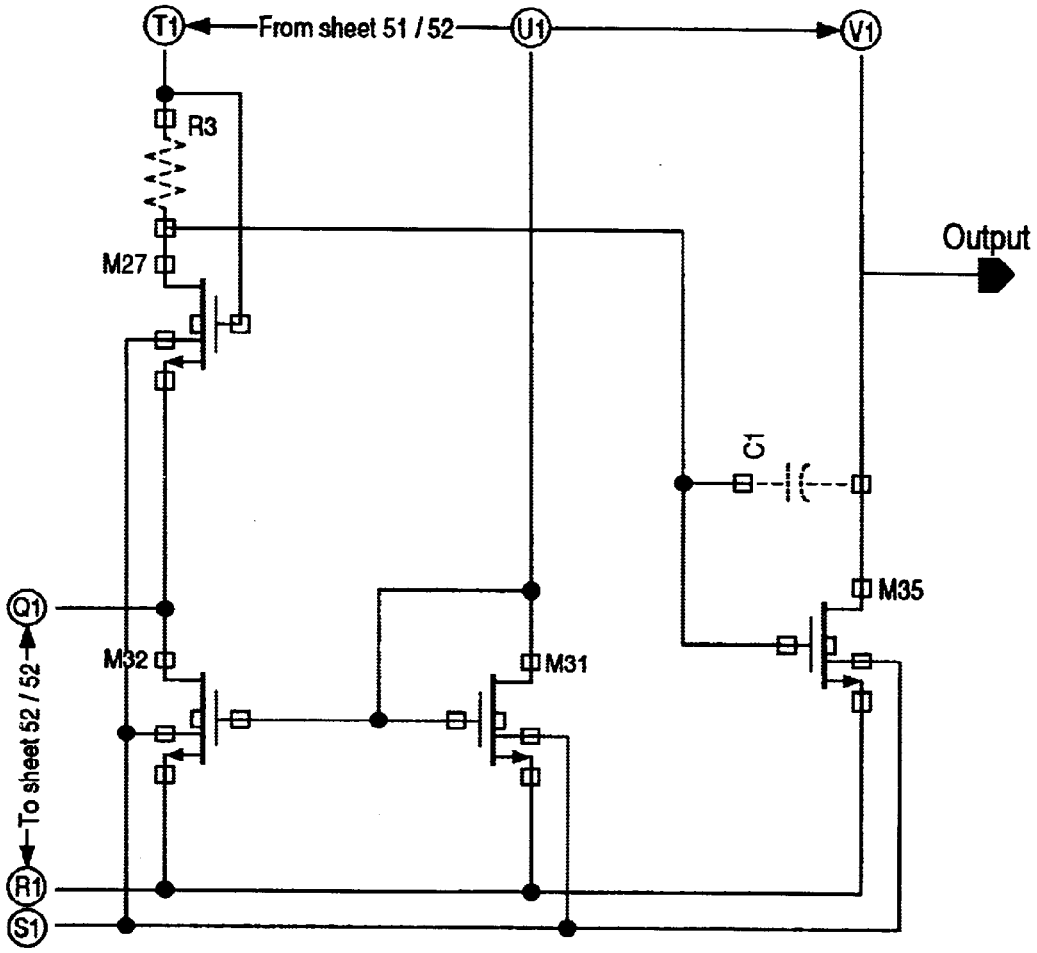

FIG. 13 is a schematic diagram further illustrating one embodiment of input stage 904 that may be implemented as part of the present invention. In this embodiment, full rail-to-rail operation is achieved with a supply voltage of less than one volt.

In summary, in its various embodiments, the present invention provides a sub-bandgap circuit that furnishes a stable reference voltage with an operating supply voltage less than the bandgap potential and also less than a zero-bias threshold voltage. Some of the key elements of the sub-bandgap circuit include a sub-threshold current reference with forward biasing of the P-channel bodies, a Gmb-based op-amp, and a zero current POR.

Because of the averaging nature of this approach ((Vbe+ΔVbe·A)/2), the sensitivity to manufacturing tolerances is reduced, resulting in an inherent improvement in yields and reduced sensitivities to process voltages and temperatures (PVT). In effect, the sub-bandgap mode of operation is made superior to the bandgap operating at lower voltages and power and described elsewhere.

Another advantage is that the circuit designs presented herein lend themselves to standard CMOS fabrication techniques in relatively high threshold processes, which are readily carried over to deep sub-micron digital processes.

The preferred embodiment of the present invention is thus described. While the present invention has been described in particular embodiments, it should be appreciated that the present invention should not be construed as limited by such embodiments, but rather construed according to the below claims.

What is claimed is:

1. A sub-bandgap circuit comprising:

an operational amplifier having an N-well input stage; and a proportional to absolute temperature current source coupled to said operational amplifier and having a forward-biased P-bulk, wherein said circuit outputs a reference voltage that is less than the bandgap potential of silicon with an operating supply voltage less than the bandgap potential of silicon.

2. The sub-bandgap circuit of claim 1 wherein said operating supply voltage is also less than a zero-bias threshold voltage.

3. The sub-bandgap circuit of claim 1 further comprising a zero current power-on reset coupled to said current source.

4. The sub-bandgap circuit of claim 1 wherein said operational amplifier comprises a voltage doubler.

5. The sub-bandgap circuit of claim 1 wherein said current source comprises a Vittoz source.

6. The sub-bandgap circuit of claim 1 wherein said P-bulk is coupled to a resistor divider.

7. The sub-bandgap circuit of claim 1 wherein said current source comprises a plurality of Gmb-based stages for increasing gain.

8. The sub-bandgap circuit of claim 1 wherein said current source uses a proportional to absolute temperature current of approximately 640 nano-amps.

9. A sub-bandgap circuit comprising:

a zero current power-on reset;

a pre-regulator coupled to said power-on reset;

a proportional to absolute temperature current source coupled to said power-on reset, wherein a P-bulk of said current source is forward-biased;

a resistor divider coupled to said P-bulk; and an operational amplifier coupled to said power-on reset, wherein said sub-bandgap circuit provides a reference voltage that is less than the bandgap potential of silicon with an operating supply voltage less than the bandgap potential of silicon and less than a zero-bias threshold voltage.

10. The sub-bandgap circuit of claim 9 wherein said operational amplifier comprises an N-well input stage.

11. The sub-bandgap circuit of claim 9 wherein said operational amplifier comprises a voltage doubler.

12. The sub-bandgap circuit of claim 9 wherein said current source comprises a plurality of Gmb-based stages for increasing gain.

13. The sub-bandgap circuit of claim 9 wherein said current source comprises a Vittoz source.

14. The sub-bandgap circuit of claim 9 wherein said current source uses a proportional to absolute temperature current of approximately 640 nano-amps.

15. A sub-bandgap circuit comprising:

a zero current power-on reset;

a pre-regulator coupled to said power-on reset;

a Vittoz current source coupled to said power-on reset;

a resistor divider coupled to said current source; and an operational amplifier coupled to said power-on reset, said operational amplifier having an N-well input stage, wherein said sub-bandgap circuit provides a reference voltage that is less than the bandgap potential of silicon with an operating supply voltage less than the bandgap potential of silicon and less than a zero-bias threshold voltage.

16. The sub-bandgap circuit of claim 15 wherein a P-bulk of said current source is forward-biased.

17. The sub-bandgap circuit of claim 15 wherein said operational amplifier comprises a voltage doubler.

18. The sub-bandgap circuit of claim 15 wherein said current source comprises a plurality of Gmb-based stages for increasing gain.

19. The sub-bandgap circuit of claim 15 wherein said current source uses a proportional to absolute temperature current of approximately 640 nano-amps.

20. The sub-bandgap circuit of claim 15 wherein said operational amplifier comprises an oscillator and a phase generator.

* * * * *